United States Patent [19]

Sakai

[11] Patent Number: 4,766,057

[45] Date of Patent: Aug. 23, 1988

[54] METHOD OF FORMING A COLOR IMAGE

[75] Inventor: Nobuo Sakai, Ashigara, Japan

[73] Assignee: Fuji Photo Film Co., Ltd., Kanagawa, Japan

[21] Appl. No.: 93,342

[22] Filed: Sep. 4, 1987

[30] Foreign Application Priority Data

Sep. 4, 1986 [JP] Japan ..... 61-208534

[51] Int. Cl.[4] ..... G03C 5/24; G03C 1/46; G03C 1/08; G03C 7/32

[52] U.S. Cl. ..... 430/383; 430/380; 430/384; 430/386; 430/435; 430/476; 430/503; 430/505; 430/549; 430/552; 430/558; 430/567; 430/569

[58] Field of Search ..... 430/380, 384, 386, 435, 430/476, 503, 505, 549, 552, 558, 567, 569

[56] References Cited

U.S. PATENT DOCUMENTS

| | | | |
|---|---|---|---|
| 4,399,215 | 8/1983 | Wey | 430/569 |
| 4,452,882 | 6/1984 | Akimura et al. | 430/441 |
| 4,472,496 | 9/1984 | Tanaka et al. | 430/542 |
| 4,500,630 | 2/1985 | Sato et al. | 430/551 |
| 4,540,654 | 9/1985 | Sato et al. | 430/548 |
| 4,564,591 | 1/1986 | Tanaka et al. | 430/567 |
| 4,590,155 | 5/1986 | Klötzer | 430/569 |
| 4,605,610 | 8/1986 | Klötzer | 430/567 |
| 4,621,046 | 11/1986 | Sato et al. | 430/381 |
| 4,640,890 | 2/1987 | Fujita et al. | 430/567 |

FOREIGN PATENT DOCUMENTS 0017148 10/1980 European Pat. Off. .

*Primary Examiner*—Mukund J. Shah

*Attorney, Agent, or Firm*—Sughrue, Mion, Zinn, Macpeak & Seas

[57] ABSTRACT

A method of forming a color image which comprises processing, after imagewise exposure, with a color developing solution which contains not more than 0.0025 mol of a bromine ion per liter, a silver halide color photographic material comprising a support having thereon a blue-sensitive silver halide emulsion layer, a green-sensitive silver halide emulsion layer and a red-sensitive silver halide emulsion layer, wherein silver halides in the blue-sensitive silver halide emulsion layer and the red-sensitive silver halide emulsion layer each contains at least 80 mol % of silver chloride relative to the amount of light-sensitive silver halide in mols in each of the respective emulsion layers and substantially no silver iodide, the silver halide in the green-sensitive silver halide emulsion layer contains at least 50 mol % of silver bromide relative to the amount of light-sensitive silver halide in mols in the green-sensitive emulsion layer, and the green-sensitive silver halide emulsion layer contains a magenta dye forming coupler represented by general formula (I):

(I)

wherein $R^1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group , =N— or —NH—, with the proviso that one of the Za-Zb bond and the Zb-Zc bond is a double bond and the other is a single bond; when the Zb-Zc bond is a carbon-carbon double bond, the Zb-Zc bond may be a part of a condensed aromatic ring; or $R^1$ or X may form a polymer including a dimer or more; and when Za, Zb or Zc is a substituted methine group, the substitued methine group may form a polymer including a dimer or more.

The method of forming a color image according to the present invention enables rapid processing to be conducted while controlling fog formation with high sensitivity and excellent color reproducibility.

26 Claims, No Drawings

METHOD OF FORMING A COLOR IMAGE

FIELD OF THE INVENTION

The present invention relates to a method of forming a color image and, more particularly, to a method of forming a color image which enables rapid processing to be conducted while controlling fog formation with high sensitivity and excellent color reproducibility.

BACKGROUND OF THE INVENTION

Many kinds of silver halide color photographic materials and methods of forming color images are commercially available at the present time. Various improvements and inventions thereon have been made depending on the end use. It is generally required that silver halide emulsions employed in these photographic light-sensitive materials have high sensitivity. Therefore, silver iodobromide, silver chloroiodobromide and silver chlorobromide, etc., each being mainly composed of silver bromide, are used as the silver halide in the emulsions at present. Further, various kinds of development accelerators have been investigated in order to increase the color forming property and to shorten the processing time in color development during processing of color photographic light-sensitive materials. Particularly, benzyl alcohol is widely employed at present.

Recently, however, reduction of development processing time, simplification of the processing system and operation, and achievement of low environmental pollution have been under great demand, in addition to high sensitivity.

This demand for reduction of the period of time required to develop film, simplification of laboratory work, improvement in productivity, miniaturization, and simple operation of the processing system is mostly due to the advent of small scale laboratories, designated mini-labs, etc. With respect to meeting these requirements for rapid processing, simplification of the processing system, and achievement of low environmental pollution, benzyl alcohol, which is generally used in the color developing solution, causes severe problems.

Since benzyl alcohol has low water-solubility, it is necessary to use a solvent, such as diethylene glycol, etc., in order to assist dissolution of the benzyl alcohol. These solvents containing benzyl alcohol exhibit large values of BOD (biochemical oxygen demand) and COD (chemical oxygen demand) which indicate a heavy environmental pollution load. Therefore, it is desirable to eliminate these compounds in view of the need to preserve the environment. Also, it takes a long time to dissolve benzyl alcohol in a developing solution, even when the above described solvent is employed. Thus, elimination of benzyl alcohol is desired to simplify preparation of the developing solution.

However, to simply eliminate benzyl alcohol results in a severe lag in color development, which is contrary to the commercial need for rapid processing. Thus, a substitute for the use of benzyl alcohol has been desired.

Silver halides mainly composed of silver bromide, which have been employed the most until now, are disadvantageuous for rapid processing from a theoretical point of view, since bromine ions, which are released from the silver halides when they are developed, have a development inhibiting effect. For rapid processing, silver halides mainly composed of silver chloride are preferred. However, silver halide emulsions mainly composed of silver chloride have a disadvantage in that, while they have a high development speed, they are apt to fog. This causes a severe problem in the practical use, particularly in a green-sensitive silver halide emulsion layer containing a magenta dye forming coupler, silver visual sensitivity to magenta dyes is high.

Because of the disadvantages described above, it is difficult to obtain excellent developability with silver halides mainly composed of silver chloride when using methods of forming images having relatively high sensitivity.

Accordingly, many attempts have been made to overcome these disadvantages. For instance, in order to increase sensitivity, silver chlorobromide emulsions having a high silver chloride content which contain silver chlorobromide grains having a stratiform structure are known. These silver chlorobromide emulsions are described in detail, for example, in Japanese Patent Application (OPI) Nos. 95736/83, 108533/83, 222844/85 and 222845/85, etc. (the term "OPI" as used herein means an "unexamined published application"). Further, a method for increasing sensitivity by doping the inner portions of silver halide grains with metal ions is described in Japanese Patent Application (OPI) No. 135832/80. Fog also occurs during sensitization of the grains formed. Methods for restraining such a fog are described in Japanese Patent Application (OPI) Nos. 125612/83 and 47940/86.

Although various attempts for increasing sensitivity and restraining the formation of fog with respect to silver halides mainly composed of silver chloride have been made while maintaining their excellent developability, they are still insufficient and, thus, further improvement has been desired.

SUMMARY OF THE INVENTION

Therefore, an object of the present invention is to provide a method of forming a color image which enables rapid processing, while controlling fog formation, with high sensitivity and excellent color reproducibility.

Another object of the present invention is to provide a method of forming a color image which enables rapid processing, while controlling fog formation, with high sensitivity and excellent color reproducibility, which causes little environmental pollution and simplifies preparation of a processing solution, whereby a processing system in which simplified laboratory work, increased productivity, improved miniaturization, simple operation and low environmental pollution are achieved.

Other objects of the present invention will become apparent from the following description and examples.

These objects of the present invention can be attained by a method of forming a color image which comprises processing, after imagewise exposure, with a color developing solution which contains not more than 0.0025 mol of a bromine ion per liter, a silver halide color photographic material comprising a support having thereon a blue-sensitive silver halide emulsion layer, a green-sensitive silver halide emulsion layer and a red-sensitive silver halide emulsion layer, wherein the silver halide in the blue-sensitive silver halide emulsion layer and the red-sensitive silver halide emulsion layer contains at least 80 mol% of silver chloride relative to the amount of light-sensitive silver halide in mols in each of the respective emulsion layers and substantially no silver iodide, the silver halide in the green-sensitive silver halide emulsion layer contains at least 50 mol% of silver bromide relative to the amount of light-sensitive silver halide in mols in the green-sensitive emulsion layer, and the green-sensitive silver halide emulsion layer contains a magenta dye forming coupler represented by the general formula (I):

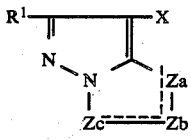

(I)

wherein $R^1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group, =N— or —NH—, with the proviso that one of the Za-Zb bond and the Zb-Zc bond is a double bond and the other is a single bond; when the Zb-Zc bond is a carbon-carbon double bond, the Zb-Zc bond may be a part of a condensed aromatic ring; or $R^1$ or X may form a polymer including a dimer or more; and when Za, Zb or Zc is a substituted methine group, the substituted methine group may form a polymer including a dimer or more.

The above described objects of the present invention can be achieved when a color photographic light-sensitive material of the present invention is processed using a color developing solution which contains not more than 0.0025 mol of bromine ion per liter and substantially no benzyl alcohol for not more than 2 minutes and 30 seconds, after imagewise exposure.

DETAILED DESCRIPTION OF THE INVENTION

The magenta dye forming coupler represented by the general formula (I) used in the present invention is described in detail below.

The term "polymer" with respect to the magenta dye forming coupler represented by general formula (I) means a compound containing at least two groups derived from a compound represented by the general formula (I) in its molecule, and includes a bis coupler, a dimer, and a polymer coupler. The polymer coupler may be either a homopolymer composed of only a monomer having a moiety represented by the general formula (I) (preferably a monomer having a vinyl group, hereinafter referred to as a vinyl monomer) or a copolymer composed of a vinyl monomer described above and a non-color forming ethylenic monomer which does not undergo coupling with the oxidation product of an aromatic primary amine developing agent.

Of the magenta dye forming couplers represented by general formula (I), preferred couplers are those represented by the following general formula (II), (III), (IV), (V), (VI), (VII) or (VIII):

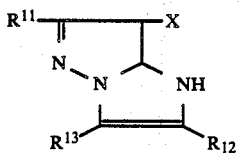

(II)

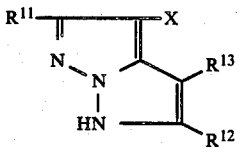

(III)

-continued

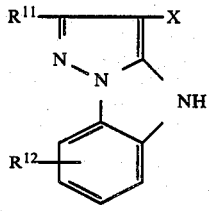

(IV)

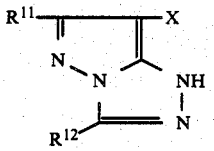

(V)

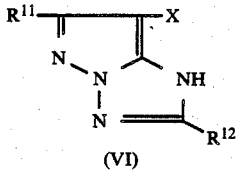

(VI)

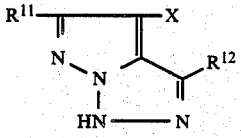

(VII)

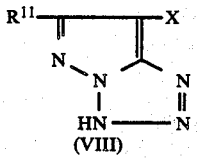

(VIII)

Among the couplers represented by the general formula (II), (III), (IV), (V), (VI), (VII) or (VIII), the couplers represented by the general formula (II), (V) or (VI) are preferred for the purpose of the present invention. Further, the couplers represented by the general formula (VI) are particularly preferred.

In the general formula (II), (III), (IV), (V), (VI), (VII) or (VIII), $R^{11}$, $R^{12}$ and $R^{13}$, which may be the same or different, each represents a hydrogen atom, a halogen atom, a linear, branched or cyclic alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or aryloxycarbonyl group which may be substituted or unsubstituted, and X represents a hydrogen atom, a halogen atom, a carboxy group or a group capable of being released upon coupling which is bonded to the carbon atom at the coupling position through an oxygen atom, a nitrogen atom or a sulfur atom.

To form a polymer including a bis coupler, $R^{11}$, $R^{12}$, $R^{13}$ or X may be a divalent group. When the coupler represented by the general formula (II), (III), (IV), (V), (VI), (VII) or (VIII) is a polymer coupler, the coupler moiety may be present in either the main chain or in one or more side chains of the polymer.

Particularly, a polymer coupler derived from a vinyl monomer having the coupler moiety represented by the general formulae (II) to (VIII) described above is preferred. In that case, $R^{11}$, $R^{12}$, $R^{13}$ or X represents a vinyl group or a linking group.

In particular, $R^{11}$, $R^{12}$ and $R^{13}$ each represents a hydrogen atom, a halogen atom (e.g., a chlorine atom, a bromine atom, etc.), a substituted or unsubstituted linear, branched or cyclic alkyl group (e.g., a methyl group, a propyl group, a tert-butyl group, a trifluoromethyl group, a tridecyl group, a 3-(2,4-di-tert-amylphenoyl)-propyl group, an allyl group, a 2-dodecyloxyethyl group, a 3-phenoxypropyl group, a 2-hexylsulfonylethyl group, a cyclopentyl group, a benzyl group, etc.), a substituted or unsubstituted aryl group (e.g., a phenyl group, a 4-tert-butylphenyl group, a 2,4-di-tert-amylphenyl group, a 4-tetradecanamidophenyl group, etc.), a substituted or unsubstituted heterocyclic group (e.g., a 2-furyl group, a 2-thienyl group, a 2-pyrimidinyl group, a 2-benzothiazolyl group, etc.), a cyano group, a substituted or unsubstituted alkoxy group (e.g., a methoxy group, an ethoxy group, a 2-methoxyethoxy group, a 2-dodecyloxyethoxy group, a 2-methanesulfonylethoxy group, etc.), a substituted or unsubstituted aryloxy group (e.g., a phenoxy group, a 2-methylphenoxy group, a 4-tert-butylphenoxy group, etc.), a substituted or unsubstituted heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-tert-amylphenoxy)butylamido group, a γ-(3-tert-butyl-4-hydroxyphenoxy)butylamido group, an α-[4-(4-hydroxyphenylsulfonyl)phenoxy]decanamido group, etc.), a substituted or unsubstituted anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-tert-butyl-4-hydroxyphenoxy)dodecanamido]anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamido group (e.g., an N,N-dipropylsulfamoylamino group, an N-methyl-N-decylsulfamoylamino group, etc.), a substituted or unsubstituted alkylthio group (e.g., a methylthio group, an octylthio group, a tetradecylthio group, a 2-phenoxyethylthio group, a 3-phenoxypropylthio group, a 3-(4-tert-butylphenoxy)propylthio group, etc.), a substituted or unsubstituted arylthio group (e.g., a phenylthio group, a 2-butoxy-5-tert-octylphenylthio group, a 3-pentadecylphenylthio group, a 2-carboxyphenylthio group, a 4-tetradecanamidophenylthio group, etc.), a substituted or unsubstituted heterocyclic thio group (e.g., a 2-benzothiazolylthio group, etc.), a substituted or unsubstituted alkoxycarbonylamino group (e.g., a methoxycarbonylamino group, a tetradecyloxycarbonylamino group, etc.), a substituted or unsubstituted aryloxycarbonylamino group (e.g., a phenoxycarbonylamino group, a 2,4-di-tert-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methoxy-5-tert-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)propyl]carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), a substituted or unsubstituted alkoxycarbonyl group (e.g., a methoxycarbonyl group, a butoxycarbonyl group, a dodecyloxycarbonyl group, an octadecyloxycarbonyl group, etc.) or a substituted or unsubstituted aryloxycarbonyl group (e.g., a phenoxycarbonyl group, a 3-pentadecyloxycarbonyl group, etc.); and X represents a hydrogen atom, a halogen atom (e.g., a chlorine atom, a bromine atom, an iodine atom, etc.), a carboxy group, a group bonded to the coupling position through an oxygen atom (e.g., an acetoxy group, a propanoyloxy group, a benzoyloxy group, a 2,4-dichlorobenzoyloxy group, an ethoxyoxaloyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenetyloxy group, a 2-phenoxyethoxy group, a 5-phenyltetrazolyloxy group, a 2-benzothiazolyloxy group, etc.), a group bonded to the coupling position through a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzyl-5-ethoxy-3-hydantoinyl group, a 2N-1,1-dioxo-3-(2H)-oxo-1,2-benzisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,3,4-tetrazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, etc.), an arylazo group (e.g., a 4-methoxyphenylazo group, a 4-pivaloylaminophenylazo group, a 2-naphthylazo group, a 3-methyl-4-hydroxyphenylazo group, etc.), or a group bonded to the coupling position through a sulfur atom (e.g., a phenylthio group, a 2-carboxyphenylthio group, a 2-methoxy-5-tert-octylphenylthio group, 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

In the coupler represented by the general formula (II) or (III), $R^{12}$ and $R^{13}$ may combine with each other to form a 5-membered, 6-membered or 7-membered ring.

When $R^{11}$, $R^{12}$, $R^{13}$ or X represents a divalent group to form a bis coupler, $R^{11}$, $R^{12}$ or $R^{13}$ preferably represents a substituted or unsubstituted alkylene group, which may link through a hetero atom (e.g, a methylene group, an ethylene group, a 1,10-decylene group, $—CH_2CH_2—O—CH_2CH_2—$, etc.), a substituted or unsubstituted phenylene group (e.g., a 1,4-phenylene group, a 1,3-phenylene group,

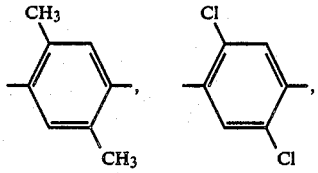

etc.), an —NHCO—$R^{14}$—CONH— group, wherein $R^{14}$ represents a substituted or unsubstituted alkylene or phenylene group (e.g., —NHCO$CH_2CH_2$CONH—,

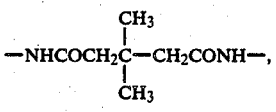

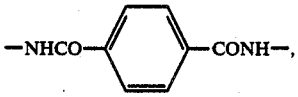

etc.); or an —S—$R^{15}$—S— group, wherein $R^{15}$ represents a substituted or unsubstituted alkylene group (e.g, —S—$CH_2CH_2$—S—,

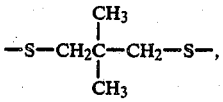

etc.); and X may represent a divalent group appropriately formed from the monovalent group represented by X as described above.

The linking group represented by $R^{11}$, $R^{12}$, $R^{13}$ or X in the cases wherein the coupler moiety represented by general formula (II), (III), (IV), (V), (VI), (VII) or (VIII) is included in a vinyl monomer includes a substituted or unsubstituted alkylene group, which may link through a hetero atom (e.g., a methylene group, an ethylene group, a 1,10-decylene group, —$CH_2CH_2OCH_2CH_2$—, etc.), a substituted or unsubstituted phenylene group (e.g., a 1,4-phenylene group, a 1,3-phenylene group,

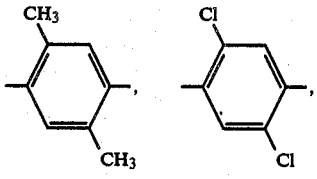

etc.), —NHCO—, —CONH—, —O—, —OCO—, and a substituted or unsubstituted aralkylene group (e.g.,

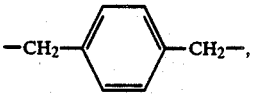

-continued

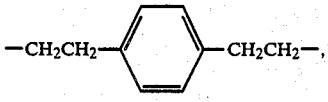

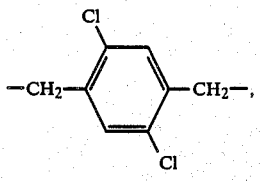

etc.) or a combination thereof.

Specific examples of preferred linking groups are set forth below.

—NHCO—, —$CH_2CH_2$—,

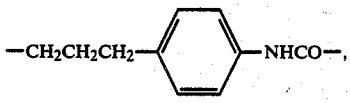

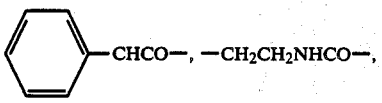

—CHCO—, —$CH_2CH_2$NHCO—,

—$CH_2CH_2$—O—C(=O)—, —CONH$CH_2CH_2$NHCO—,

—$CH_2CH_2OCH_2CH_2$NHCO—,

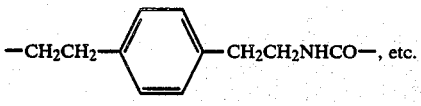

Further, a vinyl group in the vinyl monomer may further have a substituent in addition to the coupler moiety represented by general formula (II), (III), (IV), (V), (VI), (VII) or (VIII). Preferred examples of the substituents include a hydrogen atom, a chlorine atom or a lower alkyl group having from 1 to 4 carbon atoms (e.g., a methyl group, an ethyl group, etc.).

A monomer containing the coupler moiety represented by general formula (II), (III), (IV), (V), (VI), (VII) or (VIII) may form a copolymer together with a non-color forming ethylenic monomer which does not undergo coupling with the oxidation product of an aromatic primary amine developing agent.

Examples of non-color forming ethylenic monomers which do not undergo coupling with the oxidation product of an aromatic primary amine developing agent include an acrylic acid (such as acrylic acid, α-chloroacrylic acid, an α-alkylacrylic acid (e.g, methacrylic acid, etc.), an ester or an amide derived from an acrylic acid (e.g., acrylamide, n-butylacrylamide, tert-butylacrylamide, diacetoneacrylamide, methacrylamide, methyl acrylate, ethyl acrylate, n-propyl acrylate, n-butyl acrylate, tert-butyl acrylate, iso-butyl acrylate, 2-ethylhexyl acrylate, n-octyl acrylate, lauryl acrylate, methyl methacrylate, ethyl methacrylate, n-butyl methacrylate, β-hydroxy-methacrylate, etc.), methylenedibisacrylamide, a vinyl ester (e.g, vinyl acetate, vinyl propionate, vinyl laurate, etc.), acrylonitrile, methacrylonitrile, an aromatic vinyl compound (e.g, styrene and a derivative thereof, vinyltoluene, divinylbenzene, vinylacetophenone, sulfostyrene, etc.), itaconic acid, citraconic acid, crotonic acid, vinylidene chloride, a vinyl alkyl ether (e.g., vinyl ethyl ether, etc.), maleic acid, maleic anhydride, a maleic acid ester, N-vinyl-2-pyrrolidone, N-vinylpyridine, 2- or 4-vinylpyridine, etc.

Two or more kinds of non-color forming ethylenically unsaturated monomers can be used together. For example, a combination of n-butyl acrylate and methyl acrylate, styrene and methacrylic acid, methacrylic acid and acrylamide, methyl acrylate and diacetoneacrylamide, etc., can be used.

As is well known in the field of polymer color couplers, the non-color forming ethylenically unsaturated monomer which is copolymerized with a solid water-insoluble monomer coupler can be selected in such a manner that the copolymer formed has good physical properties and/or chemical properties, for example, solubility, compatibility with a binder in a photographic colloid composition such as gelatin, flexibility, heat stability, etc.

The polymer couplers used in the present invention may be water-soluble coupler or water-insoluble couplers, but polymer coupler latexes are particularly preferred as such polymer couplers.

Specific examples of the pyrazoloazole type magenta couplers represented by the general formula (I) which can be used in the present invention and methods for syntheses thereof are described, for example, in Japanese Patent Application (OPI) Nos. 162548/84, 43659/85, 171956/84, 172982/85 and 33552/85, and U.S. Pat. No. 3,061,432, etc.

Specific examples of representative magenta couplers and vinyl monomers for preparing polymer couplers according to the present invention are set forth below, but the present invention should not be construed as being limited thereto.

(M-1)

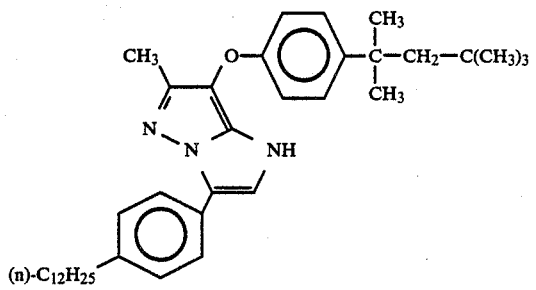

(M-2)

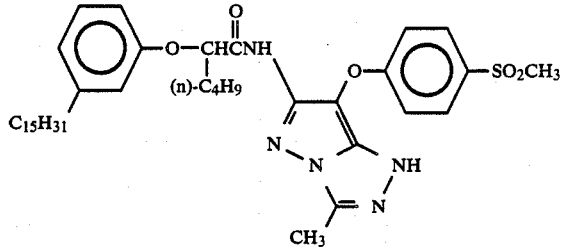

(M-3)

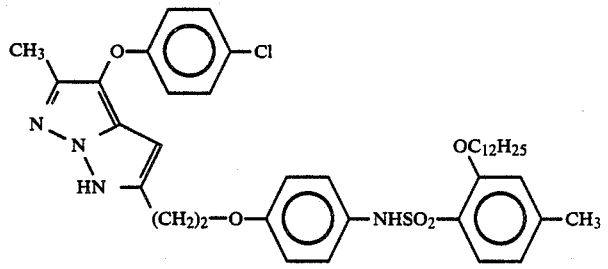

(M-4)

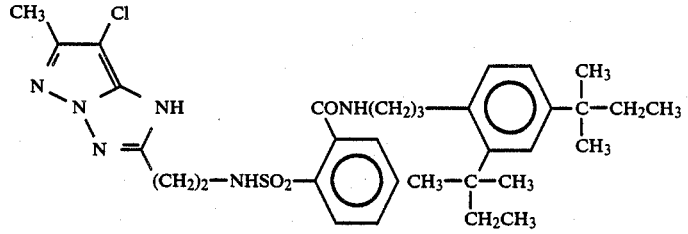

-continued
(M-5)
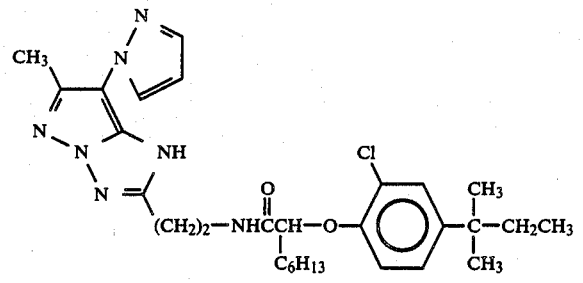
(M-6)
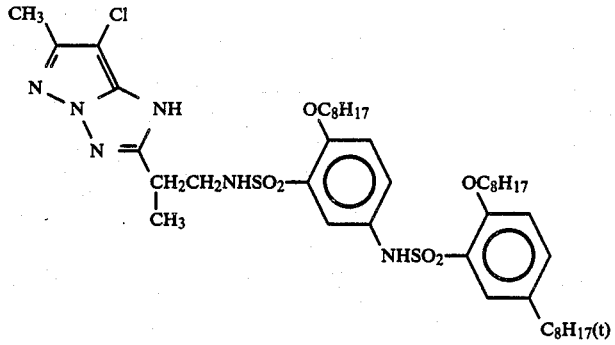
(M-7)
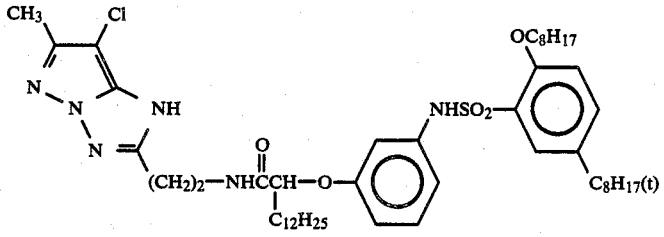
(M-8)
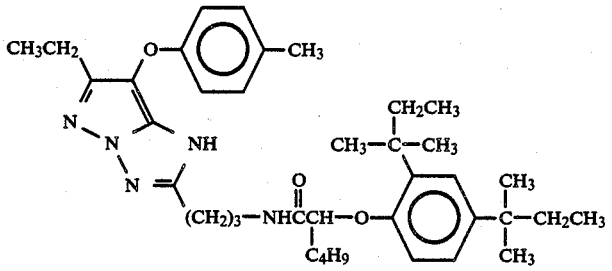
(M-9)
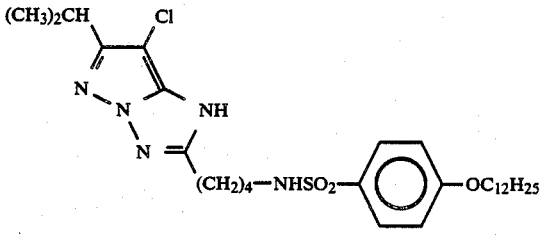
(M-10)
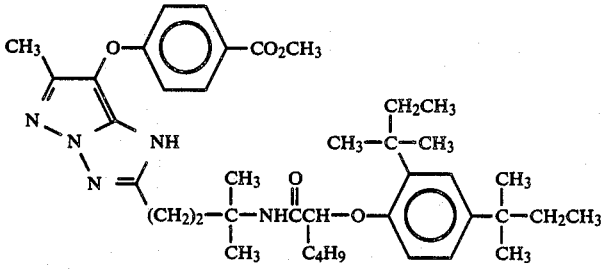

-continued
(M-11)
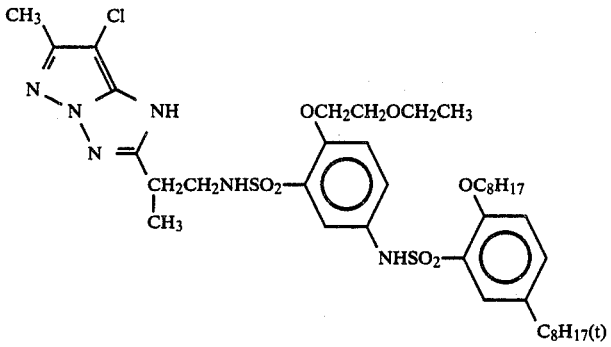
(M-12)
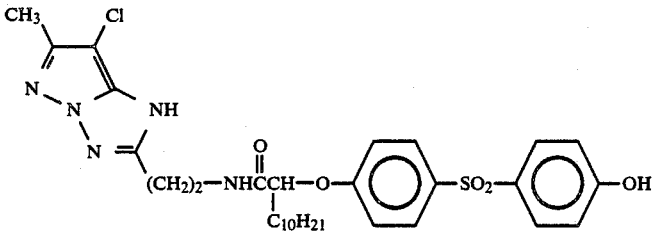
(M-13)
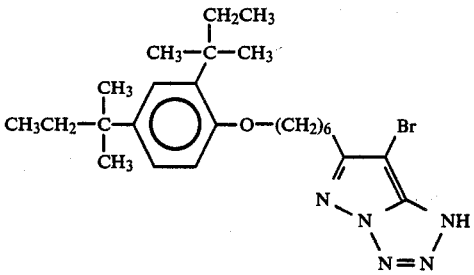
(M-14)
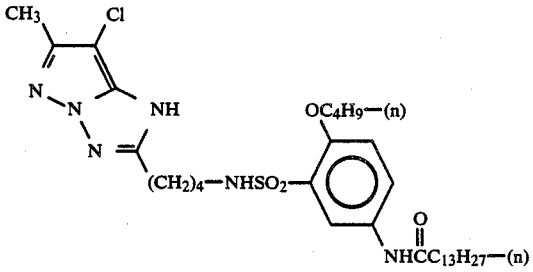
(M-15)
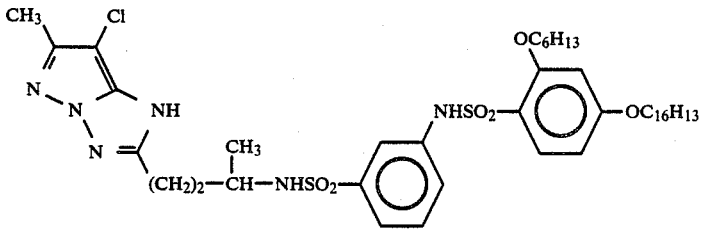

-continued
(M-16)
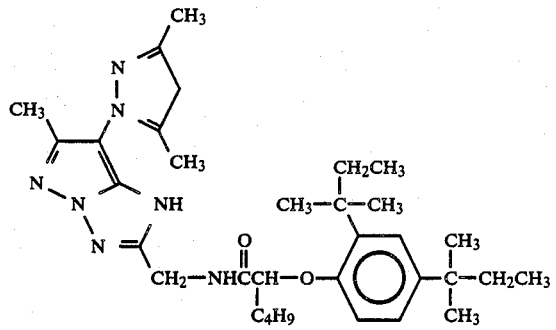
(M-17)
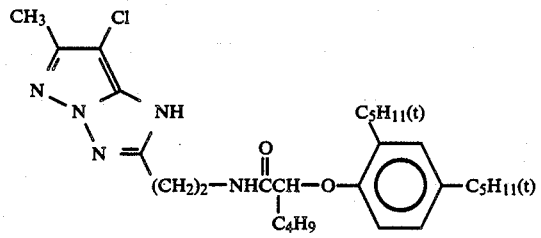
(M-18)
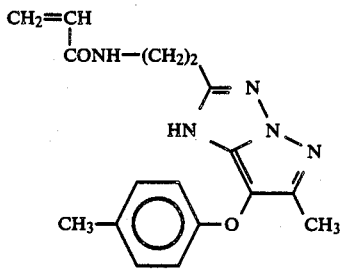
(M-19)
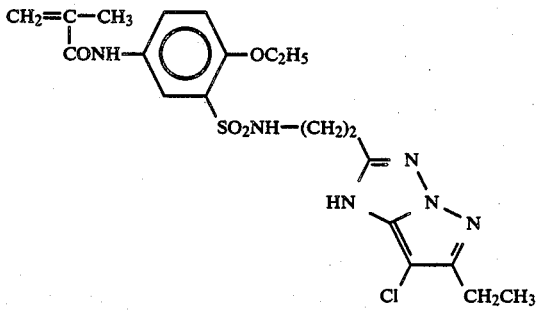
(M-20)
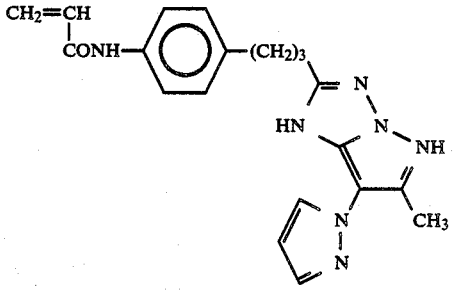

-continued
(M-21)
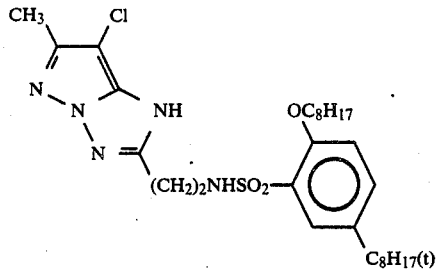
(M-22)
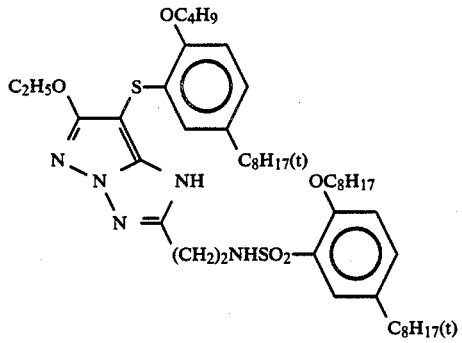
(M-23)
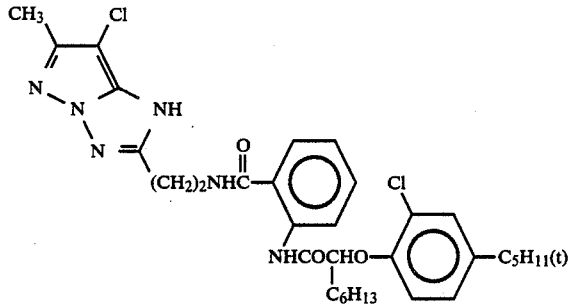
(M-24)
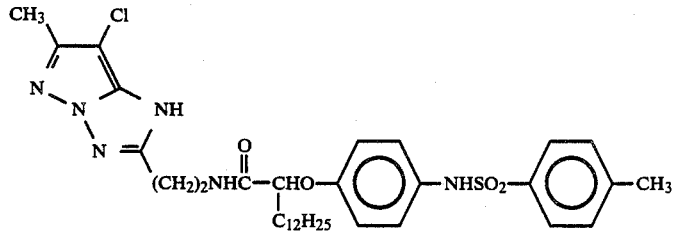
(M-25)
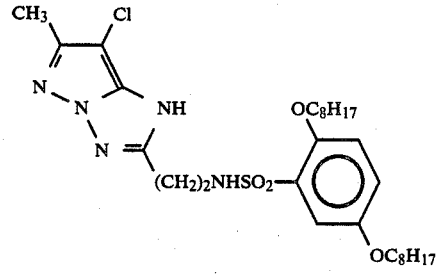

-continued
(M-26)
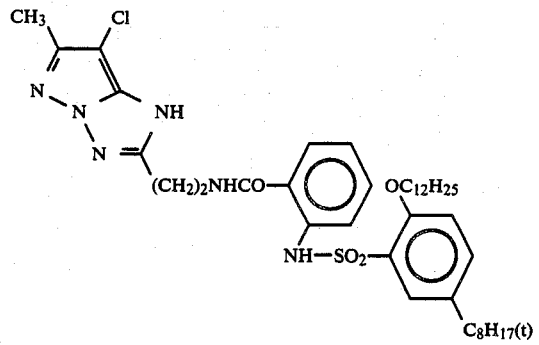
(M-27)
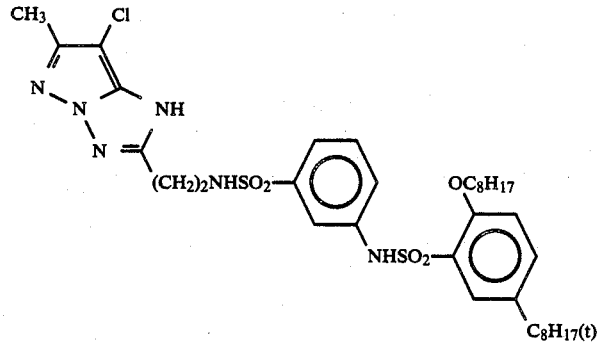
(M-28)
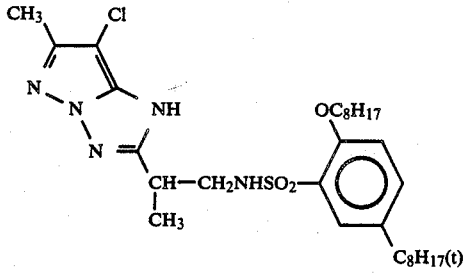
(M-29)
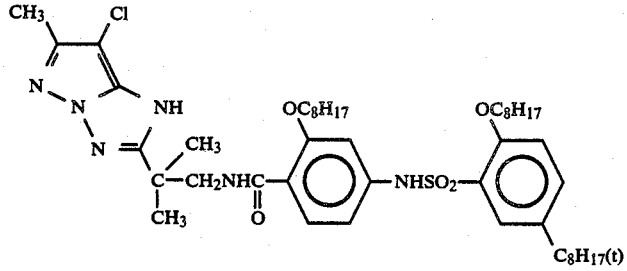
(M-30)
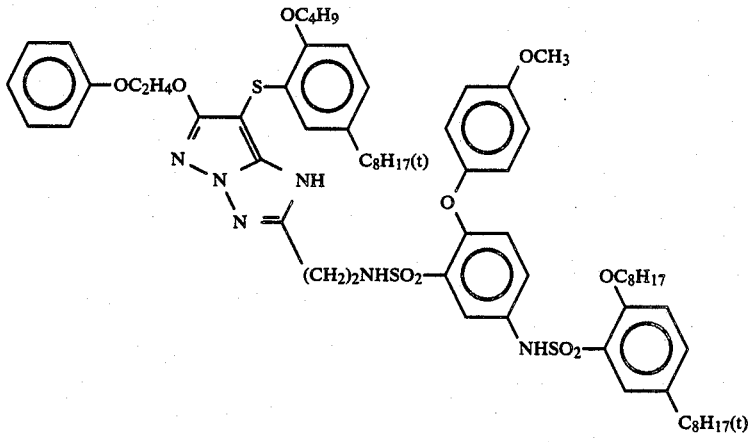

-continued
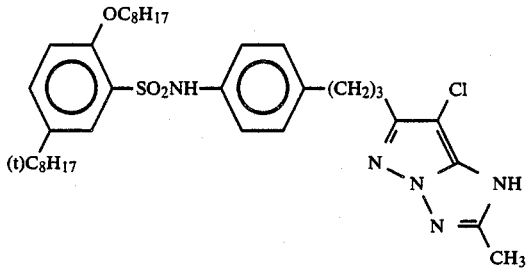
(M-31)
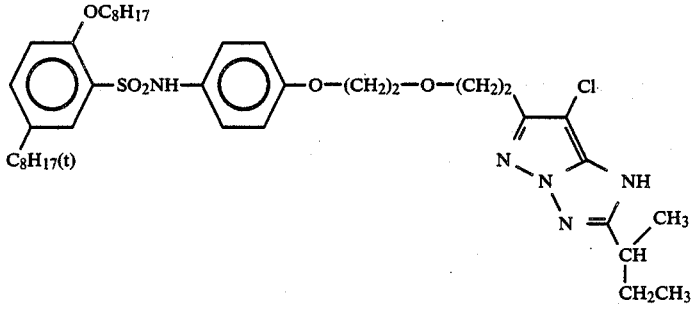
(M-32)
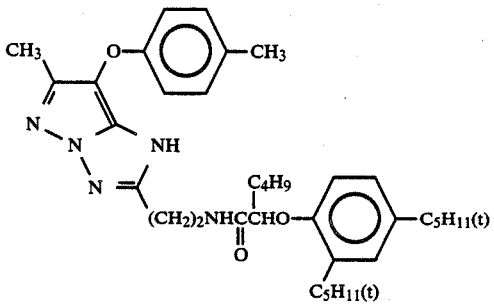
(M-33)
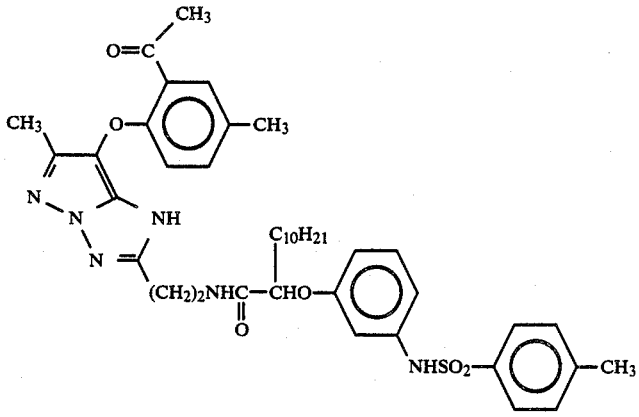
(M-34)

-continued
(M-35)
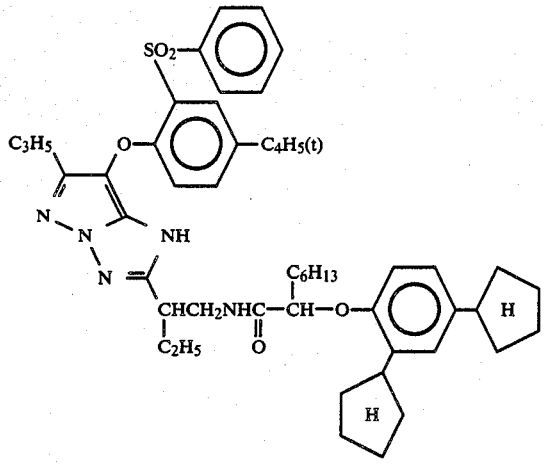
(M-36)
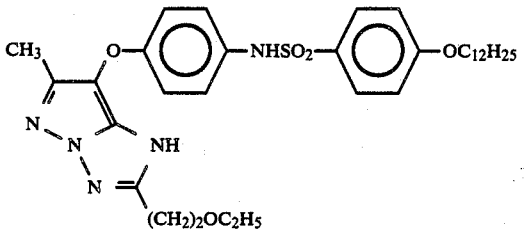
(M-37)
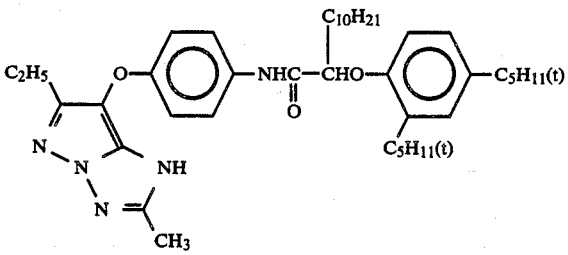
(M-38)
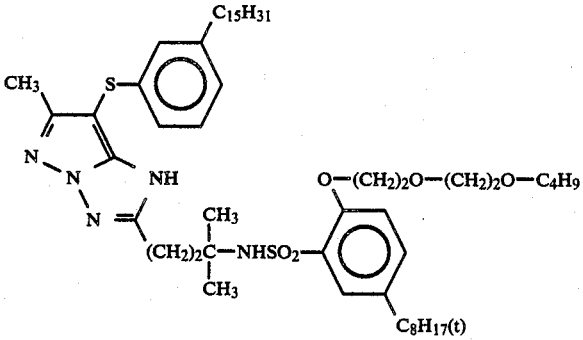
(M-39)
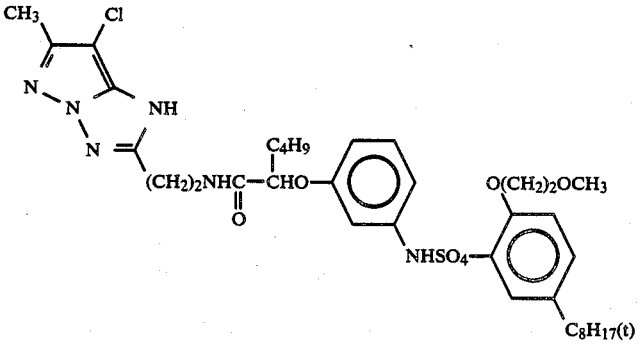

-continued
(M-40)
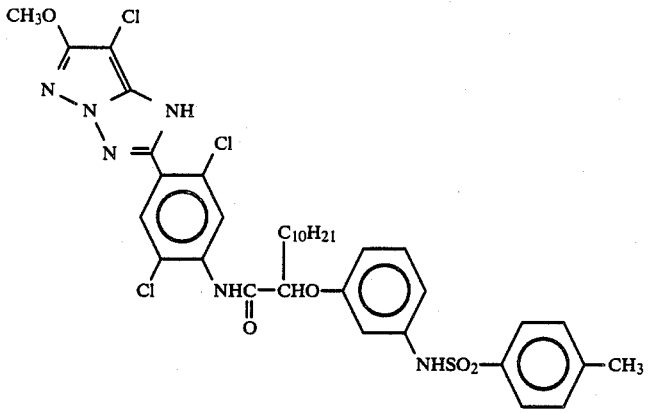
(M-41)
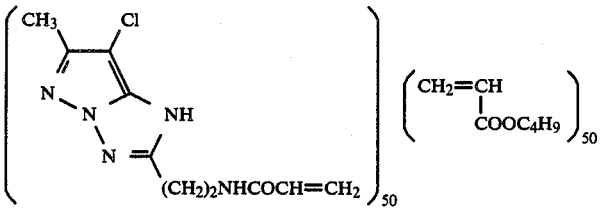
(M-42)
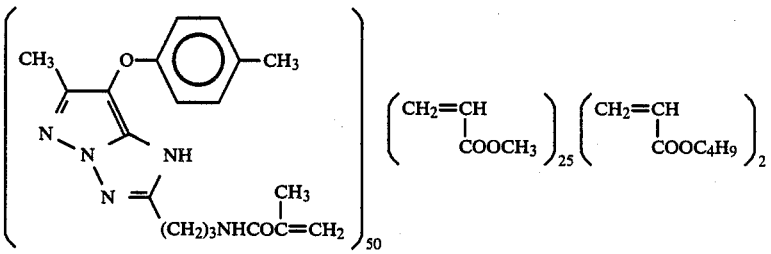
Subscripts 50, 25 and 2 in M-41 and M-42 above represent mol ratios of the monomers in brackets to be combined into a random copolymer.
(M-43)
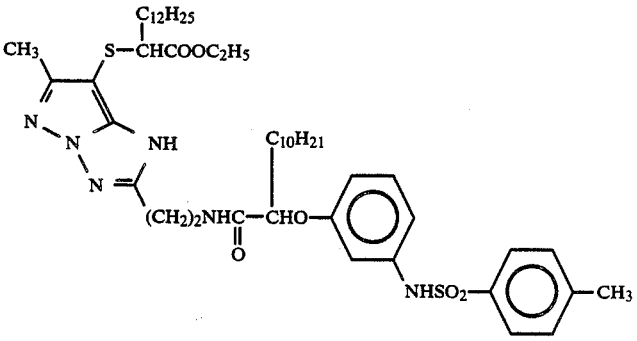

-continued
(M-44)
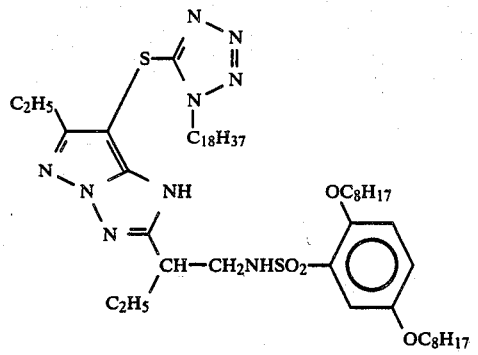
(M-45)
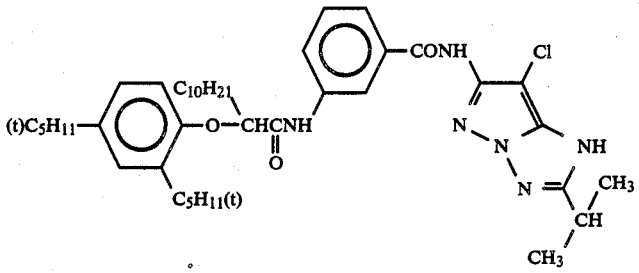
(M-46)
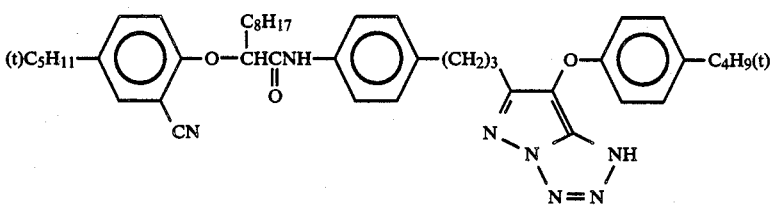
(M-47)
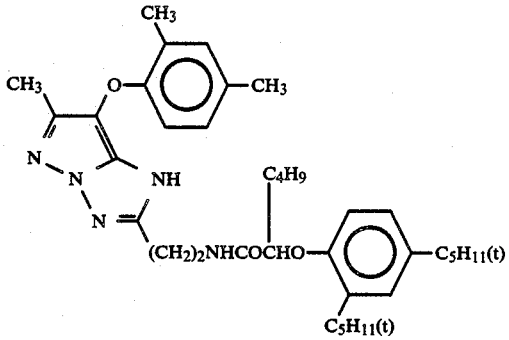
(M-48)
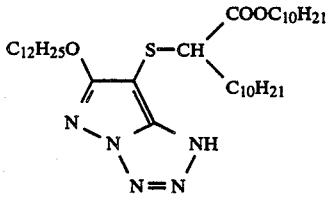
(M-49)
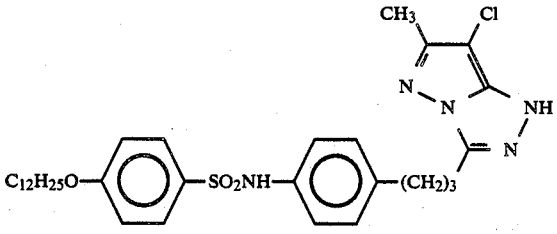

-continued
(M-50)
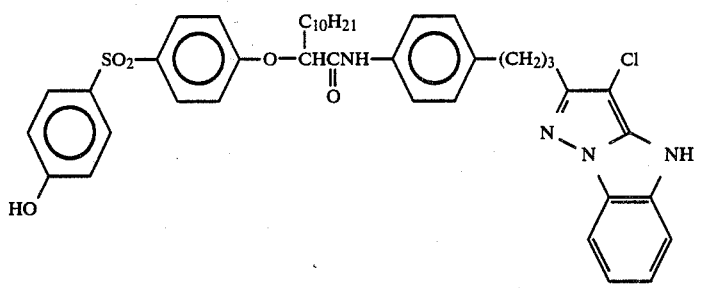
(M-51)
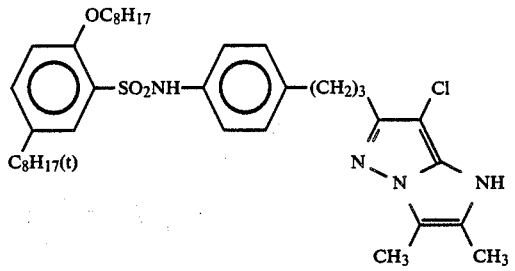
(M-52)
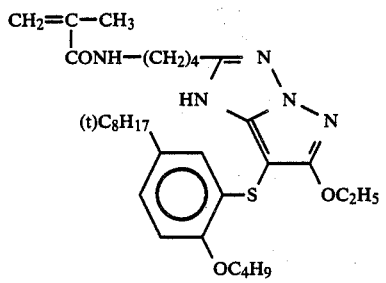
(M-53)
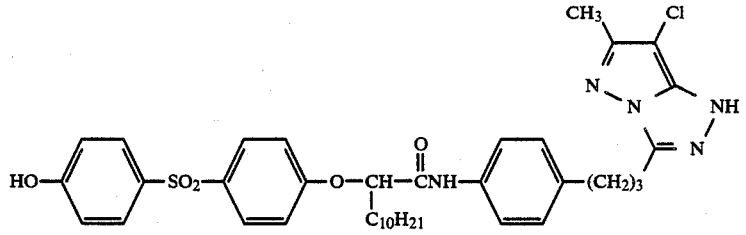
(M-54)
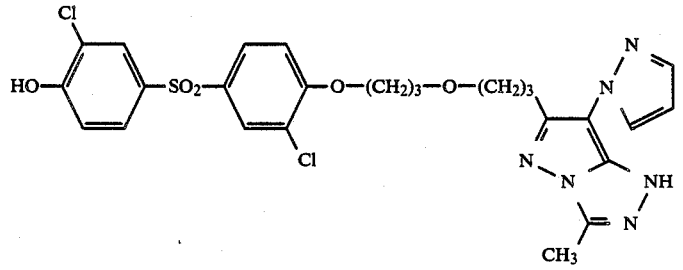
(M-55)
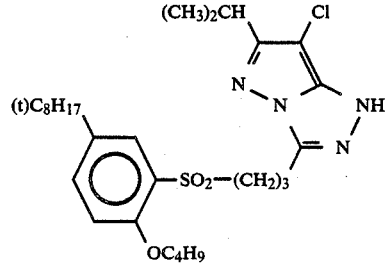

-continued (M-56)

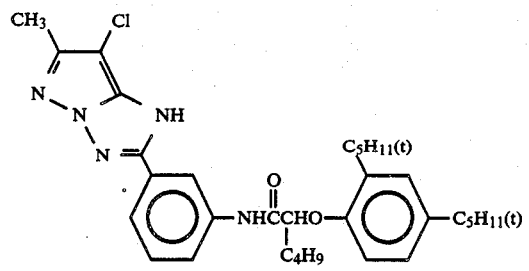

The magenta dye forming coupler represented by general formula (I) according to the present invention is incorporated into a silver halide emulsion layer in an amount of from $1\times10^{-3}$ to 1 mol and preferably from $5\times10^{-2}$ to $5\times10^{-1}$ mol per mol of silver halide present in the layer. Further, two or more kinds of the magenta dye forming couplers according to the present invention may be incorporated into the same emulsion layer.

The term "color developing solution containing substantially no benzyl alcohol" as used in the present invention means a color developing solution containing benzyl alcohol in a concentration of not more than 0.5 ml per liter of the solution. It is preferred that the color developing solution does not contain benzyl alcohol at all.

The amount of bromine ions contained in the color developing solution used in the present invention is not more than 0.0025 mol and preferably not more than 0.002 mol per liter of the solution. Most preferably, the color developing solution does not contain bromine ions at all.

The silver halide emulsion which can be used in the blue-sensitive silver halide emulsion layer and the red-sensitive silver halide emulsion layer according to the present invention is composed of silver halide containing at least 80 mol% silver chloride relative to the amount of light-sensitive silver halide (in mols) in each emulsion layer and substantially no silver iodide. The content of silver chloride in the silver halide is preferably at least 90 mol% and more preferably at least 95 mol%. A pure silver chloride emulsion can be employed. When the content of silver chloride in the emulsion is lower than the above-described value, development proceeds slowly, so that it is difficult to obtain sufficiently high density.

The term "silver halide emulsion containing substantially no silver iodide" as used in the present invention means a silver halide emulsion having a content of silver iodide of not more than 1 mol% and more preferably not more than 0.5 mol% relative to the amount of light-sensitive silver halide (in mols) in each emulsion layer. Most preferably, the silver halide emulsion does not contain silver iodide at all. To add silver iodide is not desired because of retardation in development speed and increase in fog in some cases.

The silver halide emulsion which can be used in the green-sensitive silver halide emulsion layer according to the present invention is composed of silver halide containing at least 50 mol% silver bromide relative to the amount of light-sensitive silver halide (in mols) in each emulsion layer. The content of silver bromide in the silver halide is preferably from 50 mol% to 90 mol% and, more preferably, from 65 mol% to 80 mol%.

The average grain size of the silver halide grains in the silver halide emulsion used in the present invention (the average grain size being defined as the diameter of a circle which has an area equal to the projected area of the grain) is preferably from 0.1 μm to 2 μm and more preferably from 0.2 μm to 1.3 μm. Further, it is preferred to employ a monodispersed silver halide emulsion. The grain size distribution, which represents the degree of monodispersibility, is preferably not more than 0.2 and more preferably not more than 0.15 statistical standard deviation (s) per average grain size ($\bar{d}$) ($s/\bar{d}$).

The objectives of the present invention are more effectively achieved when the amount of the silver halide included in the green-sensitive emulsion layer of the silver halide color photographic material used in the present invention, which is calculated in terms of silver, is not more than 0.26 g/m$^2$, and the amount of the silver halide coated on a support, which is calculated in terms of silver, is preferably not more than 0.78 g/m$^2$.

Silver halide grains which can be used in the present invention may have different layers in the inner portion and on the surface portion, may be multiphase structures containing junctions, or the grains may be uniform throughout. Further, a mixture of these silver halide grains having different structures may be employed.

Silver halide grains which can be used in the present invention may have a regular crystal structure, for example, a cubic, octahedral, dodecahedral, or tetradecahedral structure; an irregular crystal structure, for example, a spherical structure; or a composite structure thereof. Further, tabular silver halide grains can be used. Particularly, a silver halide emulsion can be employed wherein tabular silver halide grains having a ratio of diameter/thickness of at least 5 and, preferably, at least 8 account for at least 50% of the total projected area of the silver halide grains present. In addition, mixtures of silver halide grains having different crystal structures may be used. These silver halide emulsions may be those of the surface latent image type in which latent images are formed mainly on the surface thereof and those of the internal latent image type in which latent images are formed mainly in the interior thereof.

Photographic emulsions as used in the present invention can be prepared in any suitable manner, for example, according to the methods described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). Any of an acid process, a neutral process, and an ammonia process can be employed.

Soluble silver salts and soluble halogen salts can be combined to form silver halide grains using techniques such as a single jet process, a double jet process, and a combination thereof. In addition, there can be employed a method (known as a reverse mixing process) in which silver halide grains are formed in the presence of an excess of silver ions.

As one system of the double jet process, a so-called controlled double jet process, in which the pAg in the liquid phase where a silver halide is formed is maintained at a predetermined level, can be employed. This process produces a silver halide emulsion in which the crystal form is regular and the particle size is nearly uniform.

Further, a silver halide emulsion may be employed which is prepared by what is known as a conversion method in which a silver halide previously formed is converted to a sivler halide having a lower solubility before the completion of formation of silver halide grains or in which a silver halide emulsion is subjected to similar halogen conversion after the completion of formation of silver halide grains.

During the step of formation or physical ripening of silver halide grains, cadmium salts, zinc salts, lead salts, thallium salts, iridium salts or complex salts thereof, rhodium salts or complex salts thereof, and iron salts or complex salts thereof may be allowed to coexist with the silver ions and halide ions.

After the formation of silver halide grains, the silver halide emulsions are usually subjected to physical ripening, removal of soluble salts, and chemical ripening and then employed for coating.

Known silver halide solvents (for example, ammonia, potassium thiocyanate, and thioethers or thione compounds as described in U.S. Pat. No. 3,271,157 and Japanese Patent Application (OPI) Nos. 12360/76, 82408/78, 144319/78, 100717/79 and 155828/79) can be employed during formation, physical ripening, or chemical ripening of the silver halide.

For removal of soluble silver salts from the emulsion after physical ripening, a noodle washing process, a flocculation process, or an ultrafiltration process can be employed.

To the silver halide emulsion which can be used in the present invention, a sulfur sensitization method using active gelatin or compounds containing sulfur capable of reacting with silver (for example, thiosulfates, thioureas, mercapto compounds, and rhodanines), a reduction sensitization method using reducing substances (for example, stannous salts, amines, hydrazine derivatives, formamidinesulfinic acid, and silane compounds), a noble metal sensitization method using metal compounds (for example, complex salts of Group VIII metals in the Periodic Table, such as Pt, Ir, Pd, Rh or Fe, as well as gold complex salts); and so forth can be applied alone or in combination with each other.

Further, in order to achieve the desired gradation of the color photographic light-sensitive material, two or more monodispersed silver halide emulsions which have substantially the same color sensitivity but have different grain sizes from each other can be mixed in one emulsion layer or can be coated in the form of superimposed layers (regarding monodispersibility, the coefficient of variation described above is preferred). Moreover, two or more polydispersed silver halide emulsions or combinations of a monodispersed emulsion and a polydispersed emulsion may be employed in a mixture or in the form of superimposed layers.

Each of blue-sensitive, green-sensitive and red-sensitive emulsions used in the present invention can be spectrally sensitized with methine dyes or other dyes so as to have sensitivity to each color. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes, and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus. Furthermore, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms on these nuclei can also be substituted.

The merocyanine dyes and the complex merocyanine dyes that can be employed contain 5- or 6-membered heterocyclic nuclei such as a pyrazolin-5-one nucleus, a thiohydantoin nucleus, a 2-thioxazolidin-2,4-dione nucleus, a thiazolidin-2,4-dione nucleus, a rhodanine nucleus, and a thiobarbituric acid nucleus as nuclei having a ketomethylene structure.

These sensitizing dyes can be employed individually, but can also be employed in combination. A combination of sensitizing dyes is often used particularly for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, and Japanese Patent Application (OPI) Nos. 110618/77 and 109925/77.

The sensitizing dyes may be present in the emulsion together with dyes which themselves do not give rise to spectrally sensitizing effects, but exhibit a supersensitizing effect or materials which do not substantially absorb visible light, but exhibit a supersensitizing effect.

It is preferable that color couplers which are incorporated into photographic light-sensitive materials are made diffusion resistant by containing a ballast group or polymerizing. It is also preferred that the coupling active sites of couplers be substituted with a group capable of being split off (2-equivalent couplers) rather than with a hydrogen atom (4-equivalent couplers) since the coating amount of silver can be reduced when using 2-equivalent couplers. Further, couplers which form dyes having an appropriate diffusibility, non-color-forming couplers, or couplers capable of releasing development inhibitors (DIR couplers) or development accelerators accompanying the coupling reaction can be employed.

As typical yellow couplers used in the present invention, oil protected acylacetamide type couplers are exemplified. Specific examples thereof are described in U.S. Pat. Nos. 2,407,210, 2,875,057 and 3,265,506. In the present invention, 2-equivalent yellow couplers are preferably employed, and typical examples thereof include yellow couplers of the oxygen atom-releasing type as described in U.S. Pat. Nos. 3,408,194, 3,447,928, 3,933,501 and 4,022,620; and yellow couplers of the nitrogen atom-releasing type as described in Japanese Patent Publication No. 10739/83, U.S. Pat. Nos. 4,401,752 and 4,327,024, *Research Disclosure,* RD No. 18053 (April, 1979), British Pat. No. 1,425,020, West German Patent Application (OLS) Nos. 2,219,917, 2,261,361, 2,329,587 and 2,433,812. α-Pivaloylacetanilide type couplers are characterized by good fastness, particularly good light fastness, of the dyes formed, and α-benzoylacetanilide type couplers provide high color density.

As cyan couplers used in the present invention, oil protected naphthol type and phenol type couplers are exemplified. Typical examples thereof include naphthol type couplers as described in U.S. Pat. No. 2,474,293 and preferably oxygen atom-releasing type 2-equivalent naphthol type couplers as described in U.S. Pat. Nos. 4,052,212, 4,146,396, 4,228,233 and 4,296,200. Specific examples of phenol type couplers are described in U.S. Pat. Nos. 2,369,929, 2,801,171, 2,772,162 and 2,895,826.

Cyan couplers which have good fastness to high humidity and temperature are preferred for use in the present invention. Typical examples thereof include phenol type cyan couplers having an alkyl group larger than a methyl group at the meta-position of the phenol nucleus as described in U.S. Pat. No. 3,772,002; 2,5-diacylamino-substituted phenol type couplers as described in U.S. Pat. Nos. 2,772,162, 3,758,308, 4,126,396, 4,334,011 and 4,327,173, West German Patent Application (OLS) No. 3,329,729, and Japanese Patent Application No. 42671/83; and phenol type couplers having a phenylureido group at the 2-position thereof and an acylamino group at the 5-position thereof as described in U.S. Pat. Nos. 3,446,622, 4,333,999, 4,451,559 and 4,427,767.

Further, couplers capable of forming appropriately diffusible dyes can be used together with couplers which form nondiffusible dyes in order to improve graininess. Specific examples of such diffusible dye types of magenta couplers are described in U.S. Pat. No. 4,366,237 and British Pat. No. 2,125,570, and those of yellow, magenta, and cyan couplers are described in European Pat. No. 96,570 and West German Patent Application (OLS) No. 3,234,533.

These dye-forming couplers and special couplers described above may be used in the form of polymers including dimers or more. Typical examples of dye-forming polymer couplers are described in U.S. Pat. Nos. 3,451,820 and 4,080,211. Specific examples of magenta polymer couplers are described in British Pat. No. 2,102,173 and U.S. Pat. No. 4,367,282.

Two or more kinds of various couplers which can be used in the present invention can be incorporated together into the same layer for the purpose of satisfying the properties required of the color photographic light-sensitive materials, or the same compound can be incorporated into two or more different layers.

Couplers which can be used in the present invention may be introduced into the color photographic light-sensitive material using an oil-in-water droplet type dispersing method. By means of the oil-in-water droplet type dispersing method, couplers are dissolved in either an organic solvent having a high boiling point of 175° C. or more, a solvent known as an auxiliary solvent having a low boiling point, or a mixture thereof and, then, the solution is finely dispersed in an aqueous medium such as water or an aqueous gelatin solution in the presence of a surface active agent. Specific examples of the organic solvent having a high boiling point are described in, for example, U.S. Pat. No. 2,322,027. Preparation of a dispersion may be accompanied by phase inversion. Further, dispersions can be utilized for coating after removing or reducing the auxiliary solvent therein by distillation, noodle washing, or ultrafiltration, if desired.

Specific examples of the organic solvent having a high boiling point include phthalic acid esters (for example, dibutyl phthalate, dicyclohexyl phthalate, di-2-ethylhexyl phthalate, and didecyl phthalate), phosphoric or phosphonic acid esters (for example, triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphonate), benzoic acid esters (for example, 2-ethylhexyl benzoate, dodecyl benzoate, and 2-ethylhexyl-p-hydroxybenzoate), amides (for example, diethyldodecanamide and N-tetradecylpyrrolidone), alcohols or phenols (for example, isostearyl alcohol and 2,4-di-tert-amylphenol), aliphatic carboxylic acid esters (for example, dioctyl azelate, glycerol tributyrate, isostearyl lactate, and trioctyl citrate), aniline derivatives (for example, N,N-dibutyl-2-butoxy-5-tert-octylaniline), and hydrocarbons (for example, paraffins, dodecylbenzene, and diisopropylnaphthalene). As the auxiliary solvent, organic solvents having a boiling point of about 30° C. or more, preferably from about 50° C. to about 160° C., can be used. Typical examples of such auxiliary solvents include ethyl acetate, butyl acetate, ethyl propionate, methyl ethyl ketone, cyclohexanone, 2-ethoxyethyl acetate, and dimethylformamide.

The processes and effects of latex dispersing methods and the specific examples of latexes for loading are described in U.S. Pat. No. 4,199,363 and West German Patent Application (OLS) Nos. 2,541,274 and 2,541,230.

The color couplers are generally employed in an amount of from 0.001 mol to 1 mol per mol of the light-sensitive silver halide contained in a layer to be added. It is preferred that amounts of yellow couplers, magenta couplers, and cyan couplers used are in ranges from 0.01 mol to 0.5 mol, from 0.003 to 0.3 mol, and from 0.002 mol to 0.3 mol, respectively, per mol of the light-sensitive silver halide.

The color photographic light-sensitive material used in the present invention may contain hydroquinone derivatives, aminophenol derivatives, amines, gallic acid derivatives, catechol derivatives, ascorbic acid derivatives, non-color-forming couplers, and sulfonamidophenol derivatives, as color fog preventing agents or color mixing preventing agents.

In the color photographic light-sensitive material used in the present invention, various known color fading preventing agents can be employed. Typical examples of organic color fading preventing agents include hindered phenols, for example, hydroquinones, 6-hydroxychromans, 5-hydroxycoumarans, spirochromans, p-alkoxyphenols, and bis-phenols, gallic acid derivatives, methylenedioxybenzenes, aminophenols, hindered amines, or ether or ester derivatives thereof derived from each of these compounds by silylation or alkylation of the phenolic hydroxyl group thereof. Further, metal complexes represented by (bissalicylaldoxymate) nickel complexes and (bis-N,N-dialkyldithiocarbamate) nickel complexes may be employed.

For preventing degradation of yellow dye images due to heat, humidity, and light, compounds each having both a hindered amine partial structure and a hindered phenol partial structure in the molecule as described in U.S. Pat. No. 4,268,593 provide good results. For preventing degradation of magenta dye images, particularly degradation due to light, spiroindanes as described in Japanese Patent Application (OPI) No. 159644/81 and chromans substituted with a hydroquinone diether or monoether as described in Japanese Patent Application (OPI) No. 89835/80 provide preferred results.

In order to improve preservability, particularly light fastness of cyan dye images, it is preferred to employ a benzotriazole type ultraviolet light absorbing agent. Such an ultraviolet light absorbing agent may be emulsified together with a cyan coupler. A coating amount of the ultraviolet light absorbing agent is selected so as to sufficiently improve the light stability of cyan dye images. When the amount of the ultraviolet light absorbing agent employed is too large, yellow coloration may occur in unexposed area (white background areas) of color photographic materials containing them. Therefore, in general the amount is preferably in a range of from $1\times10^{-4}$ mol/m$^2$ to $2\times10^{-3}$ mol/m$^2$ and particularly from $5\times10^{-4}$ mol/m$^2$ to $1.5\times10^{-3}$ mol/m$^2$.

In color paper having a conventional light-sensitive layer structure, the ultraviolet light absorbing agent is incorporated into one of two layers adjacent to a red-sensitive emulsion layer containing a cyan coupler and preferably both of the adjacent layers thereof. When the ultraviolet light absorbing agent is incorporated into an interlayer positioned between a green-sensitive emulsion layer and a red-sensitive emulsion layer, it may be emulsified together with a color mixing preventing agent. In the case of adding the ultraviolet light absorbing agent to a protective layer, another protective layer may be separately provided thereon as an outermost layer. Into the outermost protective layer, a matting agent having an appropriate particle size can be incorporated.

The color photographic light-sensitive material used in the present invention may contain an ultraviolet light absorbing agent in a hydrophilic colloid layer thereof.

The color photographic light-sensitive material used in the present invention may contain water-soluble dyes as filter dyes or for irradiation or halation prevention or other various purposes in a hydrophilic colloid layer thereof.

The color photographic light-sensitive material used in the present invention may contain in the photographic emulsion layers or other hydrophilic colloid layers a brightening agent of the stilbene series, triazine series, oxazole series, or coumarin series. Water-soluble brightening agents can be employed. Also, water-insoluble brightening agents may be used in the form of a dispersion.

The present invention can be applied to a silver halide color photographic material having a blue-sensitive silver halide emulsion layer, a green-sensitive silver halide emulsion layer and a red-sensitive silver halide emulsion layer on a support, as described above. The silver halide color photographic light-sensitive material usually has at least one blue-sensitive silver halide emulsion layer, at least one green-sensitive silver halide emulsion layer, and at least one red-sensitive silver halide emulsion layer on a support, in the above order such that the blue-sensitive silver halide emulsion layer is first coating layer to be applied on the support. However, the order of the disposition of these emulsion layers can be changed from the above order to suit particular end use requirements.

Further, each of the above-described emulsion layers may be composed of two or more emulsion layers having different sensitivities. Moreover, between two or more emulsion layers sensitive to the same spectral wavelength range, a light-insensitive layer may be present.

In the color photographic light-sensitive material according to the present invention, it is preferred to provide a subsidiary layer such as a protective layer, an interlayer, a filter layer, an antihalation layer, and a back layer, as appropriate, in addition to the silver halide emulsion layer.

As the binder or the protective colloid for the photographic emulsion layers or interlayers of the color photographic light-sensitive material according to the present invention, gelatin is advantageously used, but other hydrophilic colloids can also be used.

For example, it is possible to use proteins such as gelatin derivatives, graft polymers of gelatin and other polymers, albumin, and casein; saccharide derivatives such as cellulose derivatives (e.g., hydroxyethyl cellulose, carboxymethyl cellulose, and cellulose sulfate), sodium alginate, and starch derivatives; and various synthetic hydrophilic high molecular weight substances such as homopolymers or copolymers (e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole).

As gelatin, not only lime-processed gelatin but also acid-processed gelatin and enzyme-processed gelatin as described in *Bull. Soc. Sci. Phot. Japan,* No. 16, page 30 (1966) may be used. Further, hydrolyzed products of gelatin or enzymatically decomposed products of gelatin can also be used.

Moreover, into the color photographic light-sensitive material according to the present invention can be incorporated various kinds of stabilizers, contamination preventing agents, developing agents or precursors thereof, development accelerating agents or precursors thereof, lubricants, mordants, matting agents, antistatic agents, plasticizers, or other additives useful for photographic light-sensitive materials in addition to the above-described additives. Typical examples of these additives are described in *Research Disclosure,* No. 17643 (December, 1978) and ibid., No. 18716 (November, 1979).

The support which can be employed in the present invention is preferably a reflective support.

The term "reflective support" as used herein means a support having an increased reflection property for the purpose of rendering dye images formed in the silver halide emulsion layer clear. Examples of the reflective support include a support having coated thereon a hydrophobic resin containing a light reflective substance such as titanium oxide, zinc oxide, calcium carbonate, or calcium sulfate dispersed therein, a support having coated thereon a radiation-curable resin containing a light reflective substance dispersed therein and a support composed of a hydrophobic resin containing a light reflective substance dispersed therein. More specifically, they include baryta coated paper; polyethylene coated paper; electron beam curable resin coated paper; polypropylene type synthetic paper; transparent supports, for example, a glass plate, a polyester film such as a polyethylene terephthalate film, a cellulose triacetate film, and a cellulose nitrate film; a polyamide film; a polycarbonate film; and a polystyrene film having a reflective layer or having incorporated therein a reflective substance. A suitable support can be selected as appropriate depending on the purpose for which the photographic material is used.

The processing steps (image forming steps) which are applied to the present invention are described in further detail below.

In the present invention, a preferred processing time for the color development step is not more than 2 minutes and 30 seconds. A more preferred developing time is from 10 seconds to 2 minutes. The term "processing time for a color development step" as used herein means the period of time from the time when the silver halide color photographic light-sensitive material comes into contact with the color developing solution to the time when the color photographic material comes into contact with the subsequent processing solution and, therefore, it includes the transfer time between the processing baths.

Aromatic primary amine color developing agents which can be used in the color developing solution according to the present invention include known compounds which are widely employed in various color photographic processes. These developing agents include aminophenol derivatives and p-phenylenediamine derivatives. Preferred examples are p-phenylenediamine derivatives. Typical examples of the p-phenylenediamine derivative used are set forth below, but the present invention should not be construed as being limited thereto.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-Ethyl-N-(β-hydroxyethyl)amino]aniline
D-5: 2-Methyl-4-[N-ethyl-N-(β-hydroxyethyl-)amino]aniline
D-6: N-Ethyl-N-(β-methanesulfonamidoethyl)-3-methyl-4-aminoaniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline These p-phenylenediamine derivatives may be in the form of salts such as sulfates, hydrochlorides, sulfites, or p-toluenesulfonates. The above-described compounds are described in U.S. Pat. Nos. 2,193,015, 2,552,241, 2,566,271, 2,592,364, 3,656,950 and 3,698,525. The aromatic primary amine developing agent is used in an amount of from about 0.1 g to about 20 g and preferably from about 0.5 g ot about 10 g per liter of the developing solution.

The color developing solution used in the present invention may contain hydroxylamines as is well known.

While hydroxylamines can be employed in the form of a free amine in the color developing solution, it is more common to use them in the form of a water-soluble acid salt. Examples of such salts which are usually used include a sulfate, an oxalate, a hydrochloride, a phosphate, a carbonate, and an acetate. Hydroxylamines may be substituted or unsubstituted. Further, the nitrogen atom in the hydroxylamines may be substituted with an alkyl group.

The amount of the hydroxylamine added is preferably from 0 g to 10 g and more preferably from 0 g to 5 g per liter of the color developing solution. A reduced amount of the hydroxylamine is desirable if the stability of the color developing solution can be maintained with a reduced amount present.

Also, the color developing solution used in the present invention may preferably contain sulfites such as sodium sulfite, potassium sulfite, sodium bisulfite, potassium bisulfite, sodium metasulfite, and potassium metasulfite, or carbonyl-sulfite adducts, as preservatives. The amount of these compounds added is preferably from 0 g to 20 g and more preferably from 0 g to 5 g per liter of the color developing solution. It is preferred to add these compounds in a reduced amount if the stability of the color developing solution can be maintained with a reduced amount present.

Examples of other usable preservatives include aromatic polyhydroxy compounds as described in Japanese patent application (OPI) Nos. 49282/77, 47038/81, 32140/81 and 160142/84 and U.S. Pat. No. 3,746,544; hydroxyacetones as described in U.S. Pat. No. 3,615,503 and British Pat. No. 1,306,176; α-aminocarbonyl compounds as described in Japanese patent application (OPI) Nos. 143020/77 and 89425/78; various metals as described in Japanese patent application (OPI) Nos. 44148/82 and 53749/82; various saccharides as described in Japanese patent application (OPI) No. 102727/77; hydroxamic acids as described in Japanese patent application (OPI) No. 27638/77; α,α'-dicarbonyl compounds as described in Japanese patent application (OPI) No. 160141/84; salicylic acids as described in Japanese patent application (OPI) No. 180588/84; alkanolamines as described in Japanese patent application (OPI) No. 3532/79; poly-(alkyleneimines) as described in Japanese patent application (OPI) No. 94349/81; and gluconic acid derivatives as described in Japanese patent application (OPI) No. 75647/81.

Two or more kinds of such preservatives may be employed together, if desired.

Particularly, it is preferred to add 4,5-dihydroxymbenzenedisulfonic acid, poly(ethyleneimine), and triethanolamine.

The color developing solution used in the present invention has a pH which ranges preferably from 9 to 12 and more preferably from 9 to 11.0. The color developing solution may also contain any of the compounds that are known to be usable as components of developing solutions.

In order to maintain the pH in the above-described range, various kinds of buffers are preferably employed. Examples of the buffer to be used include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, and lysine salts. Particularly, carbonates, phosphates, tetraborates, and hydroxybenzoates are preferably employed because they have advantages in that they have good solubility and excellent buffering function in a high pH range such as a pH of 9.0 or higher; they do not provide adverse effects (such as fog formation) on photographic characteristics when added to the color developing solution, and because they are inexpensive.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The present invention should not be construed as being limited to these compounds.

The amount of the buffer to be added to the color developing solution is preferably 0.1 mol or more and more preferably from 0.1 mol to 0.4 mol per liter thereof.

In addition, various chelating agents can be used in the color developing solution according to the present invention for the purpose of preventing calcium or magnesium precipitation or increasing the stability of the color developing solution.

As chelating agents, organic acid compounds are preferred, which include, for example, aminopolycarboxylic acids as described in Japanese Patent Publication Nos. 30496/73 and 30232/69; organic phosphonic acids as described in Japanese Patent Application (OPI) No. 97347/81, Japanese Patent Publication No. 39359/81, and West German Pat. No. 2,227,639; phosphonocarboxylic acids as described in Japanese Patent Application (OPI) Nos. 102726/77, 42730/78, 121127/79, 126241/80 and 65956/80; and compounds as described in Japanese Patent Application (OPI) Nos. 195845/83 and 203440/83 and Japanese Patent Publication No. 40900/78.

Specific examples of the chelating agents used are set forth below, but the present invention should not be construed as being limited thereto.

Nitrilotriacetic acid
Diethyleneaminopentaacetic acid
Ethylenediaminetetraacetic acid
Triethylenetetraminehexaacetic acid
N,N,N-Trimethylenephosphonic acid
Ethylenediamine-N,N,N',N'-tetramethylenephosphonic acid
1,3-Diamino-2-propanoltetraacetic acid
Trans-cyclohexanediaminetetraacetic acid
Nitrilotripropionic acid
1,2-Diaminopropanetetraacetic acid
Hydroxyethyliminodiacetic acid
Glycol ether diaminetetraacetic acid
Hydroxyethylenediaminetriacetic acid
Ethylenediamine-p-hydroxyphenylacetic acid
2-Phosphonobutane-1,2,4-tricarboxylic acid
1-Hydroxyethane-1,1-diphosphonic acid
N,N'-Bis(2-hydroxybenzyl)ethylenediamine-N,N'-diacetic acid Two or more kinds of such chelating agents may be employed together, if desired. The chelating agent is added to the color developing solution in an amount sufficient to block metal ions present therein. For example, a range of from about 0.1 g to about 10 g per liter of the color developing solution is employed.

The color developing solution may contain appropriate development accelerators, if desired.

Examples of suitable development accelerators include thioether type compounds as described in Japanese Patent Publication Nos. 16088/62, 5987/62, 7826/63, 12380/69 and 9019/70 and U.S. Pat. No. 3,813,247; p-phenylenediamine type compounds as described in Japanese Patent Application (OPI) Nos. 49829/77 and 15554/75; quaternary ammonium salts as described in Japanese Patent Application (OPI) Nos. 137726/75, 156826/81 and 43429/77 and Japanese Patent Publication No. 30074/69; p-aminophenols as described in U.S. Pat. Nos. 2,610,122 and 4,119,462; amine type compounds as described in U.S. Pat. Nos. 2,494,903, 3,128,182, 4,230,796, 3,253,919, 2,482,546, 2,596,926 and 3,582,346 and Japanese Patent Publication No. 11431/66; polyalkylene oxides as described in Japanese Patent Publication Nos. 16088/62, 25201/67, 11431/66 and 23883/67 and U.S. Pat. Nos. 3,138,183 and 3,532,501; 1-phenyl-3-pyrazolidones; hydrazines; mesoionic compounds; thione type compounds; and imidazoles. Of these compounds, thioether type compounds and 1-phenyl-3-pyrazolidones are preferred.

The color developing solution used in the present invention may contain appropriate antifoggants, if desired. Alkali metal halides such as potassium bromide, sodium chloride, and potassium iodide, as well as organic antifoggants, may be employed as antifoggants. Useful examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, and hydroxyazaindolizine; mercapto-substituted heterocyclic compounds, such as 2-mercaptobenzimidazole and 2-mercaptobenzothiazole; adenine; and mercapto-substituted aromatic compounds such as thiosalicylic acid. These antifoggants may accumulate in the color developing solution as a result of dissolution from the color photographic light-sensitive material being processed, and it is preferred that the amount of accumulation thereof is small from the standpoint of reduction in the amount of discharge.

It is preferred that the color developing solution according to the present invention contains fluorescent brightening agents. As fluorescent brightening agents, 4,4'-diamino-2,2'-disulfostilbene type compounds are preferred. The amount of the fluorescent brightening agent added is from 0 to 5 g and preferably from 0.1 g to 2 g per liter of the color developing solution.

Furthermore, the color developing solution according to the present invention may contain various surface active agents such as alkylphosphonic acids, arylphosphonic acids, aliphatic carboxylic acids, and aromatic carboxylic acids, if desired.

The processing temperature of the color development step used in the present invention is preferably from 30° C. to 50° C. and more preferably from 33° C. to 42° C. Further, the amount of a replenisher for the color developing solution is from 30 ml to 2,000 ml and preferably from 30 ml to 1,500 ml per square meter of the color photographic light-sensitive material. It is preferred that the amount of the replenisher be small in view of reduction in the amount of discharge.

In a bleaching step, a fixing step, a bleach-fixing step, a water washing step and/or a stabilizing step, which can be employed in the method of the present invention, there are utilized conventionally known compositions and procedures therefor.

The pH of the bleach-fixing solution or fixing solution used in the present invention is preferably from 3 to 10 and more preferably from 4 to 9. When the pH of the bleach-fixing solution or fixing solution is lower than this value, the desilvering property is increased but then the solution has a tendency to degrade and the formation of leuco dyes from cyan dyes is then accelerated. On the contrary, when the pH is higher than this value, delayed desilvering and increased stain are apt to occur.

The method according to the present invention can be applied to any processing as long as a color developing solution is employed therein. For example, it can be utilized in processing color paper, color reversal paper, color positive films, color negative films, or color reversal films.

By practicing the present invention, it is possible to achieve stable and rapid color image formation with high sensitivity, less fog formation, excellent image quality, and less processing alteration, particularly in the case of processing using a color developing solution which does not contain benzyl alcohol. Further, due to removing benzyl alcohol from the color developing solution, the environmental pollution load is remarkably reduced, and the work needed to prepare the processing solution is simplified. Moreover, since rapid processing can be carried out, productivity and promptness in preparation of color prints can be increased drastically.

The present invention is explained in greater detail with reference to the following examples, but the present invention should not be construed as being limited thereto.

Unless otherwise specified, all ratios, percents, etc., are by weight.

EXAMPLE 1

Silver Halide Emulsion (1) used in the example was prepared in the following manner.

| | |
|---|---|
| Solution 1 | |
| $H_2O$ | 1,000 ml |
| NaCl | 5.5 g |
| Gelatin | 32 g |
| Solution 2 | |
| Sulfuric acid (1N) | 20 ml |
| Solution 3 | |
| A compound (1%) of the formula: | 3 ml |

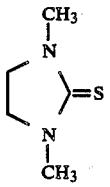

| | |
|---|---|
| Solution 4 | |
| KBr | 5.26 g |
| NaCl | 6.02 g |
| $H_2O$ to make | 130 ml |
| Solution 5 | |
| $AgNO_3$ | 25 g |
| $NH_4NO_3$ (50%) | 0.5 ml |
| $H_2O$ to make | 130 ml |
| Solution 6 | |
| KBr | 21.02 g |
| NaCl | 24.08 g |
| $K_2IrCl_6$ (0.001%) | 0.7 ml |
| $H_2O$ to make | 285 ml |
| Solution 7 | |
| $AgNO_3$ | 100 g |
| $H_2O$ to make | 285 ml |

Solution 1 was heated at 62° C., Solution 2 and Solution 3 were added thereto and, then, Solution 4 and Solution 5 were added thereto simultaneously over a period of 60 minutes. After 10 minutes, Solution 6 and Solution 7 were added simultaneously over a period of 25 minutes. After 5 minutes, the temperature was dropped, and the mixture was desalted. Water and gelatin for dispersion were added thereto, and pH was adjusted to 6.2, whereby a monodispersed cubic silver chlorobromide emulsion (having an average grain size of 1.01 μm, a coefficient of variation [a value obtained by dividing the standard deviation by an average grain size: $s/\bar{d}$] of 0.08, and a silver chloride content of 70 mol%) was obtained. The emulsion was subjected to an optimum chemical sensitization using sodium thiosulfate.

Further, Silver Halide Emulsions (2) and (3) each having a different silver chloride content were prepared in the same manner as described for Silver Halide Emulsion (1) except for changing the compositions of Solution 4 to Solution 7 into those as shown in Table 1 and Table 2 below, respectively.

TABLE 1

| | Solution | Emulsion (2) | Emulsion (3) |
|---|---|---|---|
| 4 | KBr | 2.63 g | 0.18 g |
| | NaCl | 7.31 g | 8.51 g |
| | $H_2O$ to make | 130 ml | 130 ml |
| 5 | $AgNO_3$ | 25 g | 25 g |
| | $NH_4NO_3$ (50%) | 0.5 ml | 0.5 ml |
| | $H_2O$ to make | 130 ml | 130 ml |

TABLE 2

| | Solution | Emulsion (2) | Emulsion (3) |
|---|---|---|---|
| 6 | KBr | 10.51 g | 0.70 g |
| | NaCl | 29.24 g | 34.06 g |
| | $K_2IrCl_6$ (0.001%) | 0.7 ml | 0.7 ml |
| | $H_2O$ to make | 285 ml | 285 ml |
| 7 | $AgNO_3$ | 100 g | 100 g |
| | $NH_4NO_3$ (50%) | 2.0 ml | 2.0 ml |
| | $H_2O$ to make | 285 ml | 285 ml |

The average grain size, coefficient of variation, and halogen composition of each of Silver Halide Emulsions (1) to (3) are described in Table 3 below.

TABLE 3

| Emulsion | Average Grain Size (μm) | Coefficient of Variation (s/d) | Halogen Composition Br (%) | Halogen Composition Cl (%) |
|---|---|---|---|---|
| (1) | 1.01 | 0.08 | 30 | 70 |
| (2) | 1.01 | 0.07 | 15 | 85 |
| (3) | 1.02 | 0.08 | 1 | 99 |

Moreover, Silver Halide Emulsion (4) used in the example was prepared in the following manner.

| | |
|---|---|
| Solution 8 | |
| $H_2O$ | 1,000 ml |
| NaCl | 5.5 g |
| Gelatin | 32 g |
| Solution 9 | |
| Sulfuric acid (1N) | 24 ml |
| Solution 10 | |
| A compound (1%) of the formula: | 3 ml |

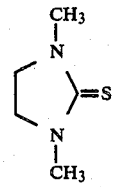

-continued

| | |
|---|---|
| Solution 11 | |
| KBr | 15.66 g |
| NaCl | 3.30 g |
| $H_2O$ to make | 200 ml |
| Solution 12 | |
| $AgNO_3$ | 32 g |
| $H_2O$ to make | 200 ml |
| Solution 13 | |
| KBr | 67.72 g |
| NaCl | 13.22 g |
| $K_2IrCl_6$ (0.001%) | 4.54 ml |
| $H_2O$ to make | 600 ml |
| Solution 14 | |
| $AgNO_3$ | 128 g |
| $H_2O$ to make | 600 ml |

Solution 8 was heated at 56° C., Solution 9 and Solution 10 were added thereto and, then, Solution 11 and Solution 12 were added thereto simultaneously over a period of 30 minutes. After 10 minutes, Solution 13 and Solution 14 were added simultaneously over a period of 20 minutes. After 5 minutes, the temperature of the above Solution mixture was lowered, and the mixture was desalted. Water and gelatin for dispersion were added thereto, and pH was adjusted to 6.2, whereby a monodispersed cubic silver chlorobromide emulsion (having an average grain size of 0.45 μm, a coefficient of variation of 0.08, and a silver bromide content of 70 mol%) was obtained. The emulsion was subjected to an optimum chemical sensitization using sodium thiosulfate.

Further, Silver Halide Emulsions (5), (6), (7) and (8) each having a different silver chloride content were prepared in the same manner as described for Silver Halide Emulsion (4) except for changing the amount of KBr and NaCl in Solution 11 and Solution 13 and the time for the addition of Solution 11 and Solution 12 into those as shown in Table 4 and Table 5 below, respectively.

TABLE 4

| | Solution | Emulsion (5) | Emulsion (6) |
|---|---|---|---|
| 11 | KBr | 8.95 g | 6.71 g |
| | NaCl | 6.60 g | 7.70 g |
| 13 | KBr | 35.84 g | 26.88 g |
| | NaCl | 26.44 g | 30.84 g |
| Time for Addition of Solution 11 and Solution 12 | | 17 min. | 12 min. |

TABLE 5

| | Solution | Emulsion (7) | Emulsion (8) |
|---|---|---|---|
| 11 | KBr | 3.36 g | 0.22 g |
| | NaCl | 9.35 g | 10.89 g |
| 13 | KBr | 13.44 g | 0.90 g |
| | NaCl | 37.44 g | 43.61 g |
| Time for Addition of Solution 11 and Solution 12 | | 10 min. | 8 min. |

The average grain size, coefficient of variation, and halogen composition of each of Silver Halide Emulsions (4) to (8) thus obtained are described in Table 6 below.

TABLE 6

| Emulsion | Average Grain Size (μm) | Coefficient of Variation (s/d) | Halogen Composition Br (%) | Halogen Composition Cl (%) |
|---|---|---|---|---|
| (4) | 0.45 | 0.08 | 70 | 30 |

TABLE 6-continued

| Emulsion | Average Grain Size (μm) | Coefficient of Variation (s/d) | Halogen Composition Br (%) | Halogen Composition Cl (%) |
|---|---|---|---|---|
| (5) | 0.45 | 0.07 | 40 | 60 |
| (6) | 0.45 | 0.08 | 30 | 70 |
| (7) | 0.45 | 0.07 | 15 | 85 |
| (8) | 0.45 | 0.08 | 1 | 99 |

10.0 g of Magenta Coupler (M-11) and 4.1 g of Color Image Stabilizer (a) were dissolved in a mixture of 13.6 ml of ethyl acetate and 10.0 ml of Solvent (b) and the resulting solution was dispersed and emulsified in 150 ml of a 10% aqueous solution of gelatin containing 7.5 ml of a 10% aqueous solution of sodium dodecylbenzenesulfonate.

To each of Emulsions (4) to (6) described above was added $4.0\times10^{-4}$ mol of Green-Sensitive Sensitizing Dye (c) shown below per mol of the silver halide to prepare green-sensitive emulsions. Using these green-sensitive emulsions and the above-described coupler dispersion in combination, coating solutions for a green-sensitive silver halide emulsion layer were prepared.

In a similar manner, coating solutions for a blue-sensitive silver halide emulsion layer and coating solutions for a red-sensitive silver halide emulsion layer were prepared using Emulsions (1) to (3) and (6) to (8), sensitizing dyes and color coupler dispersions shown below in combination. Sensitizing Dye (d) was added to the silver halide emulsion for the blue-sensitive silver halide emulsion layer in an amount of $7.0\times10^{-4}$ mol per mol of the silver halide. Sensitizing Dye (e) was added to the silver halide emulsion for the red-sensitive silver halide emulsion layer in an amount of $1.0\times10^{-4}$ mol per mol of the silver halide.

On a paper support, both surfaces of which were laminated with polyethylene, were coated a first layer to a seventh layer as shown in Table 7 below, in order, using the coating solutions described above to prepare silver halide color photographic light-sensitive materials which were designated Sample No. 1 to No. 7, respectively.

Further, as irradiation preventing dyes in the layers, the compounds shown below were employed. Moreover, to each layer was added 1-oxy-3,5-dichloro-s-triazine sodium salt as a gelatin hardening agent.

Irradiation Preventing Dye for Green-Sensitive Emulsion Layer:

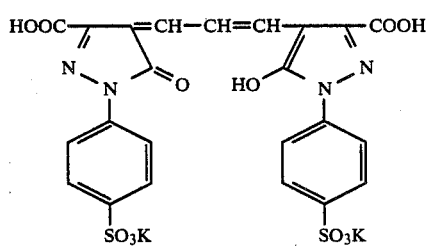

Irradiation Preventing Dye for Red-Sensitive Emulsion Layer:

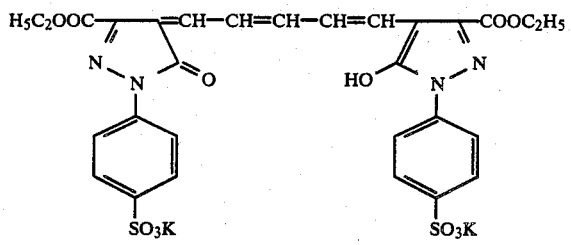

TABLE 7

| Layer | Main Components | Amount used |
|---|---|---|
| 7th Layer (Protective layer) | Gelatin | 1.33 g/m$^2$ |
| | Acryl-modified Polyvinyl Alcohol Copolymer (degree of modification: 17%) | 0.17 g/m$^2$ |
| 6th Layer (Ultra-violet light absorbing layer) | Gelatin | 0.54 g/m$^2$ |
| | Ultraviolet Light Absorbing Agent (f) | 0.21 g/m$^2$ |
| | Solvent (h) | 0.09 ml/m$^2$ |
| 5th Layer (Red-Sensitive Layer) | Silver Halide Emulsion (shown in Table 8) | 0.22 g/m$^2$ (as silver) |
| | Gelatin | 0.90 g/m$^2$ |
| | Cyan Coupler (i) | 0.36 g/m$^2$ |
| | Color Image Stabilizer (j) | 0.17 g/m$^2$ |
| | Solvent (k) | 0.22 ml/m$^2$ |

TABLE 7-continued

| Layer | Main Components | Amount used |
|---|---|---|
| 4th Layer (Ultra-violet light absorbing layer) | Gelatin | 1.60 g/m$^2$ |
| | Ultraviolet Light Absorbing Agent (f) | 0.62 g/m$^2$ |
| | Color Mixing Preventing Agent (g) | 0.50 g/m$^2$ |
| | Solvent (h) | 0.26 ml/m$^2$ |
| 3rd Layer (Green-sensitive layer) | Silver Halide Emulsion (shown in Table 8) | 0.15 g/m$^2$ (as silver) |
| | Gelatin | 1.80 g/m$^2$ |
| | Magenta Coupler (M-11) | 0.30 g/m$^2$ |
| | Color Image Stabilizer (a) | 0.12 g/m$^2$ |
| | Solvent (b) | 0.30 ml/m$^2$ |
| 2nd Layer (Color-mixing Preventing layer) | Gelatin | 0.99 g/m$^2$ |
| | Color Mixing Preventing Agent (l) | 0.08 g/m$^2$ |
| 1st Layer (Blue-sensitive layer) | Silver Halide Emulsion (shown in Table 8 | 0.26 g/m$^2$ (as silver) |
| | Gelatin | 1.83 g/m$^2$ |
| | Yellow Coupler (m) | 0.91 g/m$^2$ |
| | Color Image Stabilizer (n) | 0.19 g/m$^2$ |
| | Solvent (k) | 0.36 ml/m$^2$ |
| Support | Polyethylene laminated paper (the polyethylene coating containing a white pigment ($TiO_2$) and a bluish sye (ultramarine) on the first layer side). | |

The silver halide emulsions used in the light-sensitive emulsion layers and the magenta couplers are shown in Table 8 below.

TABLE 8

| | First Layer | Third Layer | | Fifth Layer | |
|---|---|---|---|---|---|
| Sample No. | Silver Halide Emulsion | Silver Halide Emulsion | Magenta Coupler | Silver Halide Emulsion | Remark |
| 1 | Emulsion (1) | Emulsion (4) | (M-11) | Emulsion (6) | Comparison |
| 2 | (2) | (5) | " | (7) | Comparison |
| 3 | (3) | (6) | " | (8) | Comparison |
| 4 | (3) | (4) | " | (8) | Present Invention |
| 5 | (3) | (4) | (M-30) | (8) | Present Invention |
| 6 | (3) | (4) | (O) | (8) | Comparison |
| 7 | (3) | (6) | (O) | (8) | Comparison |

Color Image Stabilizer (a):

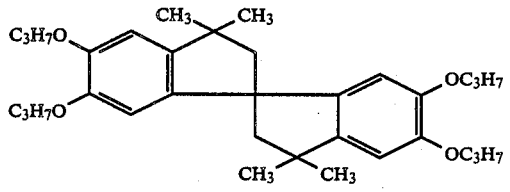

Solvent (b):

A 1:2 mixture (vol ratio) of

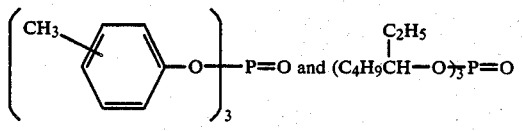

Green-Sensitive Sensitizing Dye (c):

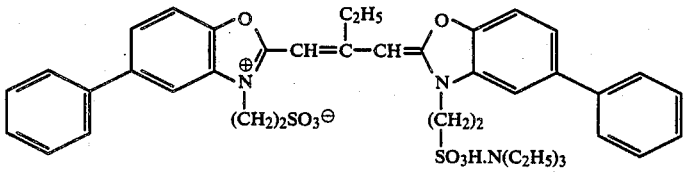

Blue-Sensitive Sensitizing Dye (d):

Red-Sensitive Sensitizing Dye (e):

-continued
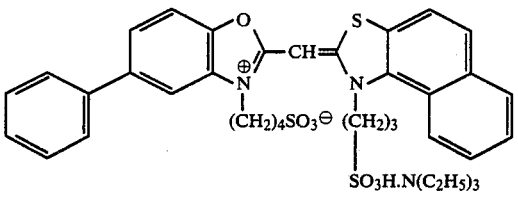
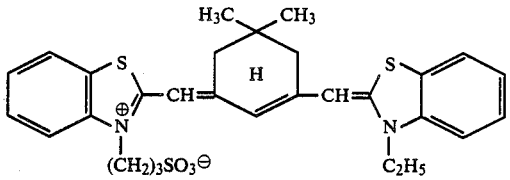
Ultraviolet Light Absorbing Agent (f):
A mixture of
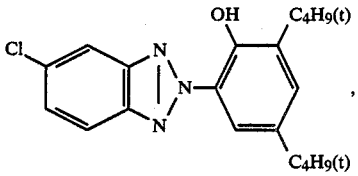
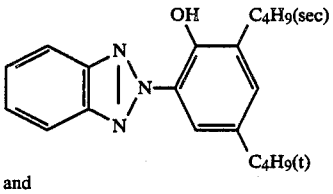
and
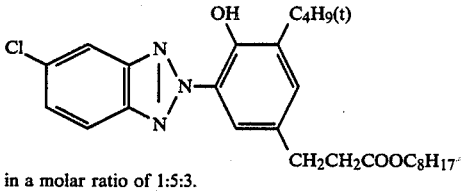
in a molar ratio of 1:5:3.
Color Mixing Preventing Agent (g):
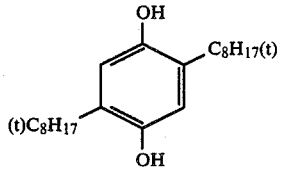
Solvent
$((iso)\text{-}C_9H_{19}O)_3P{=}O$
Cyan Coupler (i):
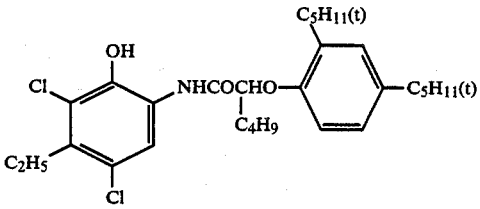
Color Image Stabilizer (j):
A mixture of
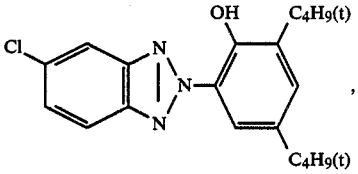
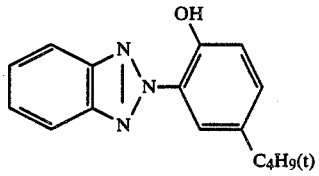
and
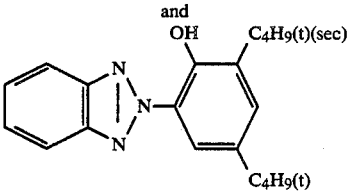
in a molar ratio of 1:3:3.
Solvent (k):
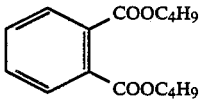
Color Mixing Preventing Agent (l):
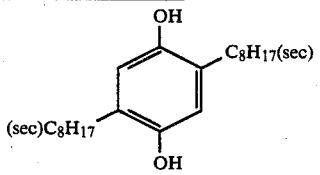
Yellow Coupler (m):

-continued

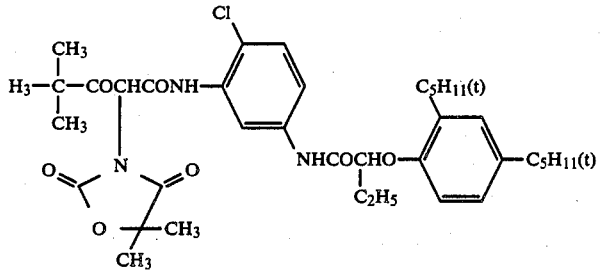

Color Image Stabilizer (n):

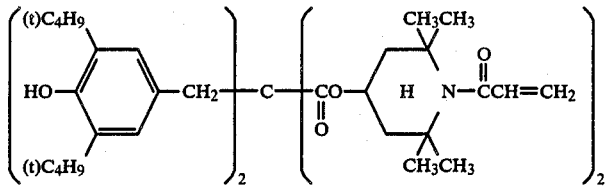

Comparative Magenta Coupler (o):

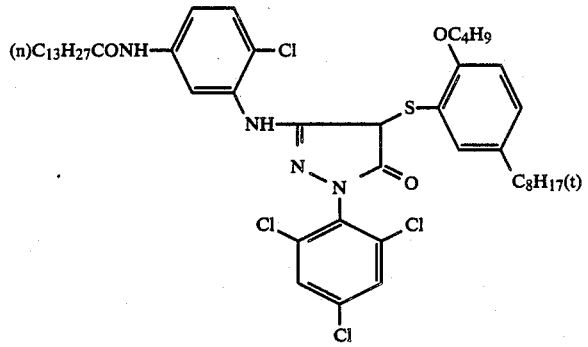

Sample Nos. 1 to 7 thus prepared were subjected to stepwise exposure for sensitometry through a three color separation filter using a sensitometer (FWH type manufactured by Fuji Photo Film Co., Ltd.; color temperature of light source: 3200° K.). The exposure was conducted for an exposure time of 0.5 second in an exposure amount of 250 CMS.

The exposed samples were then processed according to Processes A, B and C using Color Developing Solutions (A), (B) and (C) as shown below, respectively.

Each process consisted of a color development step, a bleach-fixing step and a rinse step. In Process A, the development time was 3 minutes and 30 seconds, which was used as a standard in order to evaluate the effect of the present invention. With respect to Processes B and C, the development time was changed to 30 seconds, 45 seconds or 60 seconds to evaluate photographic properties.

The evaluation of photographic properties was conducted using three factors, i.e., fog density (Dmin), relative sensitivity and color forming property. Relative sensitivity is illustrated using the result obtained from Process A with the development time of 3 minutes and 30 seconds as the standard value. More specifically, sensitivity is the reciprocal of the exposure amount required for obtaining an optical density of fog density +0.5, and the sensitivity of each sample processed with Process A is taken as 100 and the other sensitivities obtained from other processes are relative to that obtained using Process A.

Further, rapidity of development was evaluated using the result obtained from Process A with the development time of 3 minutes and 30 seconds and as the standard value. More specifically, the exposure amount required for obtaining a color density of 1.50 using Process A with a development time of 3 minutes and 30 seconds in each sample, and color densities at this exposure amount obtained in other processes were determined to evaluate the color forming property.

The results thus-obtained are shown in Table 9 below.

| Processing Step | Temperature | Time |
|---|---|---|
| Color Development | | |
| Processing A: | 33° C. | 3 min 30 sec |
| Processing B: | 35° C. | 30 sec, 45 sec, or 60 sec |
| Processing C: | 35° C. | 30 sec, 45 sec, or 60 sec |
| Bleach-Fixing | | |
| Processing A: | 33° C. | 1 min 30 sec |
| Processing B: | 35° C. | 45 sec |
| Processing C: | 35° C. | 45 sec |
| Rinse | 28 to 35° C. | 1 min 30 sec |

Compositions of Color Developing Solutions

Color Developing Solution (A):

| | |
|---|---|
| Pentasodium diethylenetriaminepentaacetate | 2.0 g |
| Benzyl alcohol | 15 ml |
| Diethylene glycol | 10 ml |

-continued

| | |
|---|---|
| $Na_2SO_3$ | 2.0 g |
| KBr | 1.0 g |
| Hydroxylamine sulfate | 3.0 g |
| N—Ethyl-N—(β-methanesulfonamidoethyl)-3-methyl-4-aminoaniline sulfate | 5.0 g |
| $Na_2CO_3$ (monohydrate) | 30.0 g |
| Fluorescent whitening agent (stilbene type) | 1.0 g |
| Water to make | 1,000 ml |
| pH | 10.2 |

Color Developing Solution (B):

| | |
|---|---|
| Water | 800 ml |
| Diethylenetriaminepentaacetic acid | 1.0 g |
| Sodium sulfite | 0.2 g |
| N,N—Diethylhydroxylamine | 4.2 g |
| Potassium bromide | 0.6 g |
| Sodium chloride | 1.5 g |
| Triethanolamine | 8.0 g |
| Potassium carbonate | 30 g |
| N—Ethyl-N—(β-methanesulfonamido-ethyl)-3-methyl-4-aminoaniline sulfate | 4.5 g |
| 4,4'-Diaminostilbene type fluorescent whitening agent (Whitex 4 manufactured by Sumitomo Chemical Co., Ltd.) | 2.0 g |
| Water to make | 1,000 ml |
| adjusted pH to 10.25 with KOH | |

Color Developing Solution (C):

| | |
|---|---|
| Water | 800 ml |
| Diethylenetriaminepentaacetic acid | 1.0 g |
| Sodium sulfite | 0.2 g |
| N,N—Diethylhydroxylamine | 4.2 g |
| Potassium bromide | 0.01 g |
| Sodium chloride | 1.5 g |
| Triethanolamine | 8.0 g |
| N—Ethyl-N—(β-methanesulfonamido-ethyl)-3-methyl-4-aminoaniline sulfate | 4.5 g |
| 4,4'-Diaminostilbene type fluorescent whitening agent (Whitex 4 manufactured by Sumitomo Chemical Co., Ltd.) | 2.0 g |
| Water to make | 1,000 ml |
| adjusted pH to 10.25 with KOH | |

Bleach-Fixing Solution:

| | |
|---|---|
| Ammonium thiosulfates (54% by weight aqueous solution) | 150 ml |
| $Na_2SO_3$ | 15 g |
| $NH_4$[Fe(III)(EDTA)] | 55 g |
| EDTA.2Na | 4 g |
| Glacial acetic acid | 8.61 g |
| Water to make | 1,000 ml |
| pH | 5.4 |

Rinse Solution:

| | |
|---|---|
| EDTA.2Na.$2H_2O$ | 0.4 g |
| Water to make | 1,000 ml |
| pH | 7.0 |

TABLE 9

| Sample No. | Layer* | Processing Time | Processing A $D_{min}$ | Processing A Relative Sensitivity | Processing A Color Forming Property | Processing Time | Processing B $D_{min}$ | Processing B Relative Sensitivity | Processing B Color Forming Property | Processing C $D_{min}$ | Processing C Relative Sensitivity | Processing C Color Forming Property |
|---|---|---|---|---|---|---|---|---|---|---|---|---|
| 1 | B | 30 min 30 sec | 0.08 | 100 | 1.5 | 30 sec | 0.08 | 20 | 0.12 | 0.08 | 51 | 0.43 |
| | | | | | | 45 sec | 0.08 | 50 | 0.40 | 0.08 | 85 | 1.05 |
| | | | | | | 60 sec | 0.08 | 58 | 0.60 | 0.09 | 89 | 1.25 |
| | G | 30 min 30 sec | 0.10 | 100 | 1.5 | 30 sec | 0.10 | 58 | 0.35 | 0.10 | 98 | 1.30 |
| | | | | | | 45 sec | 0.10 | 78 | 0.75 | 0.10 | 100 | 1.48 |
| | | | | | | 60 sec | 0.10 | 85 | 1.00 | 0.10 | 102 | 1.53 |
| | R | 30 min 30 sec | 0.11 | 100 | 1.5 | 30 sec | 0.11 | 55 | 0.35 | 0.11 | 85 | 0.88 |
| | | | | | | 45 sec | 0.11 | 73 | 0.63 | 0.11 | 90 | 1.04 |
| | | | | | | 60 sec | 0.11 | 78 | 0.75 | 0.11 | 92 | 1.17 |
| 2 | B | 30 min 30 sec | 0.08 | 100 | 1.5 | 30 sec | 0.08 | 52 | 0.48 | 0.08 | 78 | 1.26 |
| | | | | | | 45 sec | 0.08 | 80 | 1.24 | 0.09 | 98 | 1.45 |
| | | | | | | 60 sec | 0.08 | 86 | 1.32 | 0.10 | 102 | 1.51 |
| | G | 30 min 30 sec | 0.10 | 100 | 1.5 | 30 sec | 0.10 | 80 | 1.20 | 0.10 | 96 | 1.38 |
| | | | | | | 45 sec | 0.10 | 93 | 1.35 | 0.11 | 103 | 1.51 |
| | | | | | | 60 sec | 0.10 | 101 | 1.48 | 0.13 | 113 | 1.55 |
| | R | 30 min 30 sec | 0.11 | 100 | 1.5 | 30 sec | 0.11 | 75 | 0.70 | 0.11 | 95 | 1.37 |
| | | | | | | 45 sec | 0.11 | 87 | 1.05 | 0.11 | 102 | 1.48 |
| | | | | | | 60 sec | 0.11 | 95 | 1.35 | 0.12 | 105 | 1.59 |
| 3 | B | 30 min 30 sec | 0.07 | 100 | 1.5 | 30 sec | 0.07 | 65 | 0.78 | 0.09 | 97 | 1.45 |
| | | | | | | 45 sec | 0.07 | 84 | 1.29 | 0.11 | 105 | 1.55 |
| | | | | | | 60 sec | 0.08 | 88 | 1.37 | 0.14 | 110 | 1.62 |
| | G | 30 min 30 sec | 0.16 | 100 | 1.5 | 30 sec | 0.10 | 89 | 1.38 | 0.10 | 104 | 1.48 |
| | | | | | | 45 sec | 0.10 | 97 | 1.43 | 0.13 | 109 | 1.55 |
| | | | | | | 60 sec | 0.14 | 103 | 1.56 | 0.16 | 114 | 1.59 |
| | R | 30 min 30 sec | 0.11 | 100 | 1.5 | 30 sec | 0.11 | 82 | 1.01 | 0.12 | 100 | 1.49 |
| | | | | | | 45 sec | 0.11 | 90 | 1.18 | 0.13 | 107 | 1.57 |
| | | | | | | 60 sec | 0.13 | 97 | 1.39 | 0.14 | 111 | 1.63 |
| 4 | B | 30 min 30 sec | 0.07 | 100 | 1.5 | 30 sec | 0.07 | 60 | 0.68 | 0.08 | 95 | 1.42 |
| | | | | | | 45 sec | 0.07 | 81 | 1.23 | 0.08 | 102 | 1.52 |
| | | | | | | 60 sec | 0.07 | 86 | 1.35 | 0.09 | 107 | 1.60 |
| | G | 30 min 30 sec | 0.10 | 100 | 1.5 | 30 sec | 0.10 | 58 | 0.35 | 0.10 | 98 | 1.32 |
| | | | | | | 45 sec | 0.10 | 78 | 0.76 | 0.10 | 100 | 1.49 |
| | | | | | | 60 sec | 0.10 | 85 | 1.01 | 0.10 | 103 | 1.55 |
| | R | 30 min 30 sec | 0.11 | 100 | 1.5 | 30 sec | 0.11 | 79 | 0.81 | 0.11 | 98 | 1.44 |
| | | | | | | 45 sec | 0.11 | 89 | 1.15 | 0.11 | 103 | 1.52 |
| | | | | | | 60 sec | 0.11 | 96 | 1.37 | 0.12 | 107 | 1.59 |
| | B | 30 min 30 sec | 0.07 | 100 | 1.5 | 30 sec | 0.07 | 60 | 0.68 | 0.08 | 95 | 1.42 |
| | | | | | | 45 sec | 0.07 | 82 | 1.24 | 0.08 | 102 | 1.52 |

TABLE 9-continued

| Sample No. | Layer* | Processing Time | Processing A $D_{min}$ | Processing A Relative Sensitivity | Processing A Color Forming Property | Processing Time | Processing B $D_{min}$ | Processing B Relative Sensitivity | Processing B Color Forming Property | Processing C $D_{min}$ | Processing C Relative Sensitivity | Processing C Color Forming Property |
|---|---|---|---|---|---|---|---|---|---|---|---|---|
| | | | | | | 60 sec | 0.07 | 86 | 1.35 | 0.09 | 107 | 1.60 |
| | G | 30 min 30 sec | 0.10 | 100 | 1.5 | 30 sec | 0.10 | 59 | 0.40 | 0.10 | 97 | 1.38 |
| 5 | | | | | | 45 sec | 0.10 | 79 | 0.79 | 0.10 | 100 | 1.50 |
| | | | | | | 60 sec | 0.10 | 87 | 1.05 | 0.10 | 102 | 1.54 |
| | R | 30 min 30 sec | 0.11 | 100 | 1.5 | 30 sec | 0.11 | 79 | 0.82 | 0.11 | 98 | 1.45 |
| | | | | | | 45 sec | 0.11 | 89 | 1.15 | 0.11 | 102 | 1.52 |
| | | | | | | 60 sec | 0.11 | 96 | 1.37 | 0.12 | 108 | 1.60 |
| | B | 30 min 30 sec | 0.07 | 100 | 1.5 | 30 sec | 0.07 | 60 | 0.67 | 0.09 | 95 | 1.42 |
| | | | | | | 45 sec | 0.07 | 81 | 1.22 | 0.11 | 101 | 1.51 |
| | | | | | | 60 sec | 0.08 | 86 | 1.35 | 0.14 | 106 | 1.58 |
| | G | 30 min 30 sec | 0.10 | 100 | 1.5 | 30 sec | 0.10 | 41 | 0.30 | 0.10 | 65 | 0.65 |
| 6 | | | | | | 45 sec | 0.10 | 63 | 0.60 | 0.10 | 85 | 1.20 |
| | | | | | | 60 sec | 0.12 | 75 | 0.78 | 0.10 | 92 | 1.25 |
| | R | 30 min 30 sec | 0.11 | 100 | 1.5 | 30 sec | 0.11 | 79 | 0.82 | 0.12 | 98 | 1.45 |
| | | | | | | 45 sec | 0.11 | 89 | 1.15 | 0.13 | 102 | 1.52 |
| | | | | | | 60 sec | 0.13 | 96 | 1.37 | 0.14 | 107 | 1.59 |
| | B | 30 min 30 sec | 0.07 | 100 | 1.5 | 30 sec | 0.07 | 65 | 0.77 | 0.09 | 97 | 1.45 |
| | | | | | | 45 sec | 0.07 | 84 | 1.29 | 0.11 | 105 | 1.54 |
| | | | | | | 60 sec | 0.08 | 88 | 1.37 | 0.14 | 110 | 1.62 |
| | G | 30 min 30 sec | 0.17 | 100 | 1.5 | 30 sec | 0.10 | 70 | 0.68 | 0.10 | 88 | 1.15 |
| 7 | | | | | | 45 sec | 0.11 | 78 | 0.84 | 0.15 | 101 | 1.48 |
| | | | | | | 60 sec | 0.16 | 89 | 1.22 | 0.20 | 110 | 1.58 |
| | R | 30 min 30 sec | 0.11 | 100 | 1.5 | 30 sec | 0.11 | 82 | 1.01 | 0.12 | 101 | 1.49 |
| | | | | | | 45 sec | 0.11 | 90 | 1.18 | 0.13 | 107 | 1.57 |
| | | | | | | 60 sec | 0.13 | 97 | 1.39 | 0.14 | 112 | 1.62 |

*Layer B represents the blue-sensitive emulsion layer, Layer G represents the green-sensitive emulsion layer, and Layer R represents the red-sensitive emulsion layer.

The values surrounded by squares in Table 9 denote the results according to the present invention.

From the results shown in Table 9, it is apparent that high color densities can be obtained without an increase in fog according to the present invention even when rapid processing is carried out using a color developing solution which does not contain benzyl alcohol.

Specifically, when the results with respect to Samples 1, 2 and 3 are compared, it can be seen that the formation of fog severely increases together with the remarkable improvement in color forming property as the silver chloride content of the silver halide emulsion increases. With respect to the green-sensitive emulsion layer, preferred color forming property is obtained by using the magenta coupler according to the present invention even when the silver halide content is low.

On the contrary, as shown in the results with respect to Samples 4, 5, 6 and 7, high color densities can be obtained without an increase in fog by the combination of the green-sensitive emulsion layer containing the magenta coupler and the silver halide emulsion having a silver bromide content of at least 50 mol% relative to the amount of light-sensitive silver halide in mols with the blue-sensitive emulsion layer and red-sensitive emulsion layer each containing the silver halide emulsion having a silver chloride content of at least 80% by mol.

These effects are novel and can not be utterly expected from knowledge with respect to the individual light-sensitive emulsion layer.

EXAMPLE 2

On a paper support laminated with polyethylene were coated a first layer to a seventh layer, in order, in the same manner as described in Example 1 to prepare silver halide color photographic light-sensitive materials which were designated Sample Nos. 8 to 13, respectively.

The combination of silver halide emulsion, the coating amount of silver halide which is calculated in terms of silver and the magenta coupler employed in the light-sensitive emulsion layer are shown in Table 10.

TABLE 10

| Sample No. | First Layer Emulsion | First Layer Coating Amount of Silver ($g/m^2$) | Third Layer Emulsion | Third Layer Coating Amount of Silver ($g/m^2$) | Magenta Coupler | Fifth Layer Emulsion | Fifth Layer Coating Amount of Silver ($g/m^2$) | Total Coating Amount of Silver ($g/m^2$) |
|---|---|---|---|---|---|---|---|---|
| 8 | (3) | 0.26 | (4) | 0.15 | (M-6) | (8) | 0.22 | 0.63 |
| 9 | (3) | 0.26 | (4) | 0.30 | (M-6) | (8) | 0.22 | 0.78 |
| 10 | (3) | 0.50 | (4) | 0.15 | (M-6) | (8) | 0.22 | 0.87 |
| 11 | (3) | 0.26 | (4) | 0.15 | (M-6) | (8) | 0.44 | 0.85 |
| 12 | (3) | 0.26 | (4) | 0.15 | (P) | (8) | 0.22 | 0.63 |
| 13 | (3) | 0.26 | (4) | 0.30 | (P) | (8) | 0.22 | 0.78 |

Comparative Magenta Coupler (P):

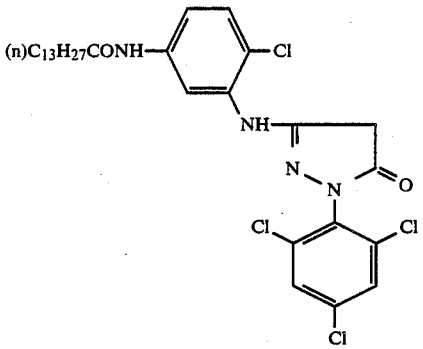

Sample Nos. 8 to 13 thus prepared were subjected to stepwise exposure and then Process C using Color Developing Solution (C) in the same manner as described in Example 1.

The evaluation of photographic properties was conducted using three factors, i.e., fog density (Dmin), relative sensitivity and color forming property same as described in Example 1. The results thus obtained are shown in Table 11.

TABLE 11

| Sample No. | Layer | Processing Time | Dmin | Process C Relative Sensitivity | Process C Color Forming Property |
|---|---|---|---|---|---|
| 8 | B | 30 sec | 0.08 | 95 | 1.42 |
| | | 45 sec | 0.08 | 102 | 1.55 |
| | | 60 sec | 0.09 | 107 | 1.60 |
| | G | 30 sec | 0.10 | 97 | 1.32 |
| | | 45 sec | 0.10 | 100 | 1.50 |
| | | 60 sec | 0.10 | 103 | 1.54 |
| | R | 30 sec | 0.11 | 98 | 1.45 |
| | | 45 sec | 0.11 | 103 | 1.52 |
| | | 60 sec | 0.12 | 107 | 1.59 |
| 9 | B | 30 sec | 0.08 | 85 | 1.33 |
| | | 45 sec | 0.08 | 93 | 1.40 |
| | | 60 sec | 0.08 | 98 | 1.48 |
| | G | 30 sec | 0.10 | 94 | 1.25 |
| | | 45 sec | 0.10 | 106 | 1.58 |
| | | 60 sec | 0.10 | 114 | 1.75 |
| | R | 30 sec | 0.11 | 89 | 1.15 |
| | | 45 sec | 0.11 | 95 | 1.38 |
| | | 60 sec | 0.11 | 99 | 1.48 |
| 10 | B | 30 sec | 0.09 | 105 | 1.59 |
| | | 45 sec | 0.10 | 111 | 1.66 |
| | | 60 sec | 0.13 | 116 | 1.73 |
| | G | 30 sec | 0.10 | 98 | 1.33 |
| | | 45 sec | 0.10 | 101 | 1.51 |
| | | 60 sec | 0.10 | 104 | 1.55 |
| | R | 30 sec | 0.11 | 98 | 1.45 |
| | | 45 sec | 0.11 | 103 | 1.52 |
| | | 60 sec | 0.12 | 107 | 1.59 |
| 11 | B | 30 sec | 0.08 | 95 | 1.41 |
| | | 45 sec | 0.08 | 102 | 1.55 |
| | | 60 sec | 0.09 | 107 | 1.59 |
| | G | 30 sec | 0.10 | 97 | 1.32 |
| | | 45 sec | 0.10 | 100 | 1.50 |
| | | 60 sec | 0.10 | 103 | 1.54 |
| | R | 30 sec | 0.12 | 105 | 1.56 |
| | | 45 sec | 0.13 | 111 | 1.66 |
| | | 60 sec | 0.14 | 118 | 1.77 |
| 12 (Comparison) | B | 30 sec | 0.08 | 95 | 1.42 |
| | | 45 sec | 0.08 | 101 | 1.53 |
| | | 60 sec | 0.09 | 106 | 1.58 |
| | G | 30 sec | 0.09 | 73 | 0.75 |
| | | 45 sec | 0.09 | 83 | 0.99 |
| | | 60 sec | 0.09 | 85 | 1.02 |
| | R | 30 sec | 0.11 | 99 | 1.46 |
| | | 45 sec | 0.11 | 104 | 1.54 |
| | | 60 sec | 0.12 | 108 | 1.59 |
| 13 | B | 30 sec | 0.08 | 84 | 1.32 |

TABLE 11-continued

| Sample No. | Layer | Processing Time | Dmin | Process C Relative Sensitivity | Process C Color Forming Property |
|---|---|---|---|---|---|
| (Comparison) | | 45 sec | 0.08 | 93 | 1.40 |
| | | 60 sec | 0.08 | 97 | 1.47 |
| | G | 30 sec | 0.09 | 89 | 1.15 |
| | | 45 sec | 0.10 | 101 | 1.50 |
| | | 60 sec | 0.10 | 108 | 1.54 |
| | R | 30 sec | 0.11 | 88 | 1.13 |
| | | 45 sec | 0.11 | 94 | 1.35 |
| | | 60 sec | 0.11 | 98 | 1.46 |

From the results shown in Table 11, it is apparent that when the coating amount of the silver halide included in the green-sensitive silver halide emulsion layer, which is calculated in terms of silver, exceeds 0.26 g/m$^2$, the color forming properties of the green-sensitive layer per se and of the other layers decrease. When the coating amount of total silver halides coated on a support, which is calculated in terms of silver, exceeds 0.78 g/m$^2$, fog remarkably increases, as seen when the results with Sample 8 are compared with those of Samples 9, 10 and 11.

Further, it can be seen from the comparison of the results with respect to Samples 12 and 13 with those of Sample 8 that the formation of color images having higher sensitivity and a lower level of fog can be achieved in a short period of time when the magenta coupler according to the present invention is used, the coating amount of the silver halide included in the green-sensitive silver halide emulsion layer which is calculated in terms of silver is not more than 0.26 g/m$^2$, and the coating amount of the total silver halides coated on a support which is calculated in terms of silver is not more than 0.78 g/m$^2$.

While the invention has been described in detail and with reference to specific embodiments thereof, it will be apparent to one skilled in the art that various changes and modifications can be made therein without departing from the spirit and scope thereof.

What is claimed is:

1. A method of forming a color image which comprises processing, after imagewise exposure, with a color developing solution which contains not more than 0.0025 mol of a bromine ion per liter, a silver halide color photographic material comprising a support having thereon a blue-sensitive silver halide emulsion layer, a green-sensitive silver halide emulsion layer and a red-sensitive silver halide emulsion layer, wherein the silver halide in the blue-sensitive silver halide emulsion layer and the red-sensitive silver halide emulsion layer contains at least 80 mol% of silver chloride relative to the amount of light-sensitive silver halide in mols in each of the respective emulsion layers and substantially no silver iodide, the silver halide in the green-sensitive silver halide emulsion layer consisting at least 50 mol% of silver bromide relative to the amount of light-sensitive silver halide in mols in the green-sensitive emulsion layer, and the green-sensitive silver halide emulsion layer contains a magenta dye forming coupler represented by formula (I):

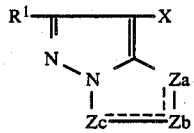

(I)

wherein $R^1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group, =N— or —NH—, with the proviso that one of the Za-Zb bond and the Zb-Zc bond is a double bond and the other is a single bond; when the Zb-Zc bond is a carbon-carbon double bond, the Zb-Zc bond may be a part of a condensed aromatic ring; or $R^1$ or X may form a polymer including a dimer or more; and when Za, Zb or Zc is a substituted methine group, the substituted methine group may form a polymer including a dimer or more.

2. A method of forming a color image as claimed in claim 1, wherein the magenta dye forming coupler is a bis coupler or a polymer coupler containing a coupler moiety represented by formula (I).

3. A method of forming a color image as claimed in claim 2, wherein the polymer coupler is a homopolymer composed of a monomer having a coupler moiety represented by formula (I) or a copolymer composed of a monomer having a coupler moiety represented by formula (I) and a non-color forming ethylenic monomer which does not undergo coupling with the oxidation product of an aromatic primary amine developing agent.

4. A method of forming a color image as claimed in claim 1, wherein the magenta dye forming coupler is represented by formula (II), (III), (IV), (V), (VI), (VII) or (VIII):

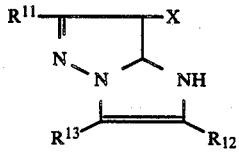

(II)

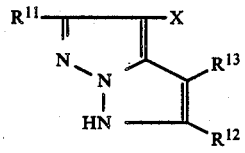

(III)

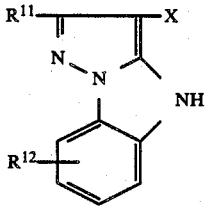

(IV)

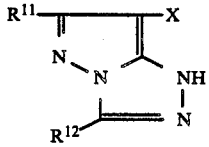

(V)

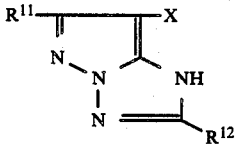

(VI)

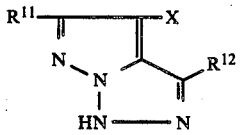

(VII)

-continued

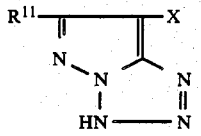

(VIII)

wherein $R^{11}$, $R^{12}$ and $R^{13}$, which may be the same or different, each represents a hydrogen atom, a halogen atom, a linear, branched or cyclic alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group which may be substituted or unsubstituted, or $R^{12}$ and $R^{13}$ in formula (II) or (III) may combine with each other to form a 5-membered, 6-membered or 7-membered ring; X represents a hydrogen atom, a halogen atom, a carboxy group or a group capable of being released upon coupling which is bonded to the carbon atom at the coupling position through an oxygen atom, a nitrogen atom or a sulfur atom; or $R^{11}$, $R^{12}$, $R^{13}$ or X may be a divalent group to form a polymer including a bis coupler.

5. A method of forming a color image as claimed in claim 4, wherein the magenta dye forming coupler is represented by formula (II), (V) or (VI).

6. A method of forming a color image as claimed in claim 4, wherein the magenta dye forming coupler is represented by formula (VI).

7. A method of forming a color image as claimed in claim 1, wherein the color developing solution contains substantially no benzyl alcohol.

8. A method of forming a color image as claimed in claim 7, wherein a concentration of benzyl alcohol is not more than 0.5 ml per liter of the color developing solution.

9. A method of forming a color image as claimed in claim 1, wherein the amount of bromine ions contained in the color developing solution is not more than 0.002 mol per liter of the solution.

10. A method of forming a color image as claimed in claim 1, wherein the silver halide in the blue-sensitive emulsion layer and the red-sensitive emulsion layer contains at least 90 mol% of silver chloride and no silver iodide at all relative to the amount of light-sensitive silver halide in mols in each of the respective emulsion layers.

11. A method of forming a color image as claimed in claim 1, wherein the silver halide in the blue-sensitive emulsion layer and the red-sensitive emulsion layer contains at least 95 mol% of silver chloride and no silver iodide at all relative to the amount of light-sensitive silver halide in mols in each of the respective emulsion layers.

12. A method of forming a color image as claimed in claim 1, wherein the silver halide in the green-sensitive emulsion layer contains from 50 mol% to 90 mol% of silver bromide relative to the amount of light-sensitive silver halide in mols in the green-sensitive emulsion layer.

13. A method of forming a color image as claimed in claim 1, wherein the silver halide in the green-sensitive emulsion layer contains from 65 mol% to 80 mol% of silver bromide relative to the amount of light-sensitive silver halide in mols in the green-sensitive emulsion layer.

14. A method of forming a color image as claimed in claim 1, wherein at least one of the silver halide emulsion is a monodispersed silver halide emulsion having a ratio of the standard deviation in grain sizze distribution to average grain size of not more than 0.2.

15. A method of forming a color image as claimed in claim 14, wherein at least one of the silver halide emulsion is a monodispersed silver halide emulsion having a ratio of the standard deviation in grain size distribution to average grain size of not more than 0.15.

16. A method of forming a color image as claimed in claim 13, wherein the average grain size of the silver halide grains in the silver halide emulsion is from 0.1 $\mu$m to 2 $\mu$m.

17. A method of forming a color image as claimed in claim 16, wherein the average grain size of the silver halide grains in the silver halide emulsion is from 0.2 $\mu$m to 1.3 $\mu$m.

18. A method of forming a color image as claimed in claim 1, wherein the amount of silver halide included in the green-sensitive emulsion layer, which is calculated in terms of silver, is not more than 0.26 g/m$^2$.

19. A method of forming a color image as claimed in claim 1, wherein the total amount of silver halide coated on the support, which is calculated in terms of silver, is not more than 0.78 g/m$^2$.

20. A method of forming a color image as claimed in claim 1, wherein the blue-sensitive silver halide emulsion layer contains a yellow color forming coupler and the red-sensitive silver halide emulsion layer contains a cyan color forming coupler.

21. A method of forming a color image as claimed in claim 20, wherein the yellow color forming coupler is an acylacetamide type coupler, and the cyan color forming coupler is selected from the group consisting of a naphthol type coupler and a phenol type coupler.

22. A method of forming a color image as claimed in claim 1, wherein the support is a reflective support.

23. A method of forming a color image as claimed in claim 1, wherein the color developing solution contains an aromatic primary amine color developing agent.

24. A method of forming a color image as claimed in claim 1, wherein the aromatic primary amine color developing agent contained in the color developing solution is N-ethyl-N-($\beta$-methanesulfonamidoethyl)-3-methyl-4-aminoaniline and the support is a reflective support.

25. A method of forming a color image as claimed in claim 1, wherein the processing time for the color development step is not more than 2 minutes and 30 seconds.

26. A method of forming a color image as claimed in claim 25, wherein the processing time for the color development step is from 10 seconds to 2 minutes.

* * * * *